United States Patent [19]

Ishii

[11] Patent Number: 4,594,931

[45] Date of Patent: Jun. 17, 1986

[54] ELECTRONIC MUSICAL INSTRUMENT FOR READING OUT AND PERFORMING MUSICAL TONE DATA PREVIOUSLY STORED

[75] Inventor: Hiroshi Ishii, Tokyo, Japan

[73] Assignee: Casio Computer Co., Ltd., Tokyo, Japan

[21] Appl. No.: 683,930

[22] Filed: Dec. 20, 1984

Related U.S. Application Data

[63] Continuation of Ser. No. 415,439, Sep. 7, 1982, Pat. No. 4,522,100, which is a continuation of Ser. No. 189,760, Sep. 23, 1980, abandoned.

[30] Foreign Application Priority Data

| | | | |
|---|---|---|---|
| Sep. 29, 1979 | [JP] | Japan | 54-126185 |
| Sep. 29, 1979 | [JP] | Japan | 54-126186 |
| Sep. 29, 1979 | [JP] | Japan | 54-126187 |
| Sep. 29, 1979 | [JP] | Japan | 54-126188 |

[51] Int. Cl.[4] ..... G10H 1/36

[52] U.S. Cl. ..... 84/1.03; 84/1.17

[58] Field of Search ..... 84/1.01, 1.03, 1.17, 84/1.24, DIG. 12, DIG. 22

[56] References Cited

U.S. PATENT DOCUMENTS

| | | | |
|---|---|---|---|
| 3,878,750 | 4/1975 | Kapps | 84/1.01 |
| 4,022,097 | 5/1977 | Strangio | 84/1.03 |
| 4,112,802 | 9/1978 | Robinson et al. | 84/1.01 |
| 4,129,055 | 12/1978 | Whittington et al. | 84/1.01 |
| 4,147,083 | 4/1979 | Woron et al. | 84/1.01 |
| 4,287,802 | 9/1981 | Imamura et al. | 84/1.01 |

*Primary Examiner*—S. J. Witkowski

*Attorney, Agent, or Firm*—Frishauf, Holtz, Goodman & Woodward

[57] ABSTRACT

An electronic musical instrument for reading out and performing musical tone data previously stored in a memory is disclosed. In the musical instrument, pitch data of a musical piece or pieces are previously stored in the memory. Desired pitch data stored are read out by operating a corresponding key arranged on a keyboard. A tone generator forms a musical tone signal on the basis of the pitch data for sounding the musical tone. When the keyboard is functionally divided into two groups, the musical tone for melody and/or accompaniment of the musical piece may be read out through the operation of the functionally divided keyboard.

18 Claims, 32 Drawing Figures

ELECTRONIC MUSICAL INSTRUMENT FOR READING OUT AND PERFORMING MUSICAL TONE DATA PREVIOUSLY STORED

This is a continuation, of application Ser. No. 415,439 filed Sept. 7, 1982, now U.S. Pat. No. 4,522,100 issued June 11, 1985, which in turn is a continuation of Ser. No. 189,760 filed Sept. 23, 1980, now abandoned.

BACKGROUND OF THE INVENTION

The present invention relates to an electronic musical instrument for reading out and performing previously stored musical tone data by means of keys on a keyboard.

Recently, electronic musical instruments have been improved in various respects to enable a beginner to handle or play it easily.

In performing a musical piece by a conventional keyboard musical instrument, a player must generally play a melody with the right hand while playing the accompaniment with the left hand in a different way from the former. To simultaneously play the musical instrument in different ways is very difficult for the beginner. Another musical instrument directed to solving this problem has been proposed in which a chord is designated by one finger of the left hand, and the chord performance is made in the form of a designated rhythm pattern in synchronism with a rhythm sound output signal from a rhythm machine or a rhythm box. In this proposal, the rhythm of the chord performance is repetitively controlled by the rhythm pattern produced from the rhythm machine or the rhythm box. Accordingly, the rhythm is simple and monotonous. Further, inverted chords described in a musical note are not produced and a bass sound is also unalterable. In addition, when using the rhythm machine or box, it is difficult for the beginner to follow the tempo of the rhythm produced from the rhythm machine or box.

Thus, an electronic musical instrument with which a beginner could play even a relatively complicated musical piece in a simple and easy manner, has eagerly been desired in this field.

SUMMARY OF THE INVENTION

Accordingly, a principal object of the present invention is to provide an electronic musical instrument in which continuous musical tone data of a musical piece are stored in a memory and, in performing the musical piece, are read out by means of keys on a keyboard.

Another object of the present invention is to provide an electronic musical instrument in which melody and/or accompaniment of the musical piece are stored in a memory and, in performing the musical piece, the stored ones are read out by means of keys on the keyboard to sound them through a tone generator.

Yet another object of the present invention is to provide an electronic musical instrument in which a keyboard is functionally divided into two sections for reading out and performing the melody and/or accompaniment.

To achieve the above object of the invention, there is provided an electronic musical instrument comprising a keyboard, a memory for storing pitch data of a musical piece such as the pitch data of melody and/or accompaniment, and means for controlling the read-out of the pitch data by means of the keyboard.

By the electronic musical instrument with such an arrangement, the pitch data of the musical piece such as those of the melody and/or accompaniment are read out and performed in accordance with the operation of keys on the keyboard which are functionally divided for read-out and performance arranged. Accordingly, in performing the musical piece, all the player has to do is to operate keys in accordance with the rhythm pattern of the musical piece such as melody and/or accompaniment. Therefore, even a difficult musical piece may be performed by a simple operation of the keyboard as described in the musical note. In this respect, the electronic musical instrument of the invention is very effective especially for the beginner.

Other objects and features of the present invention will be apparent from the following description taken in connection with the accompanying drawings.

DETAILED DESCRIPTION OF THE PREFERRED EMBODIMENTS

Figure 1:
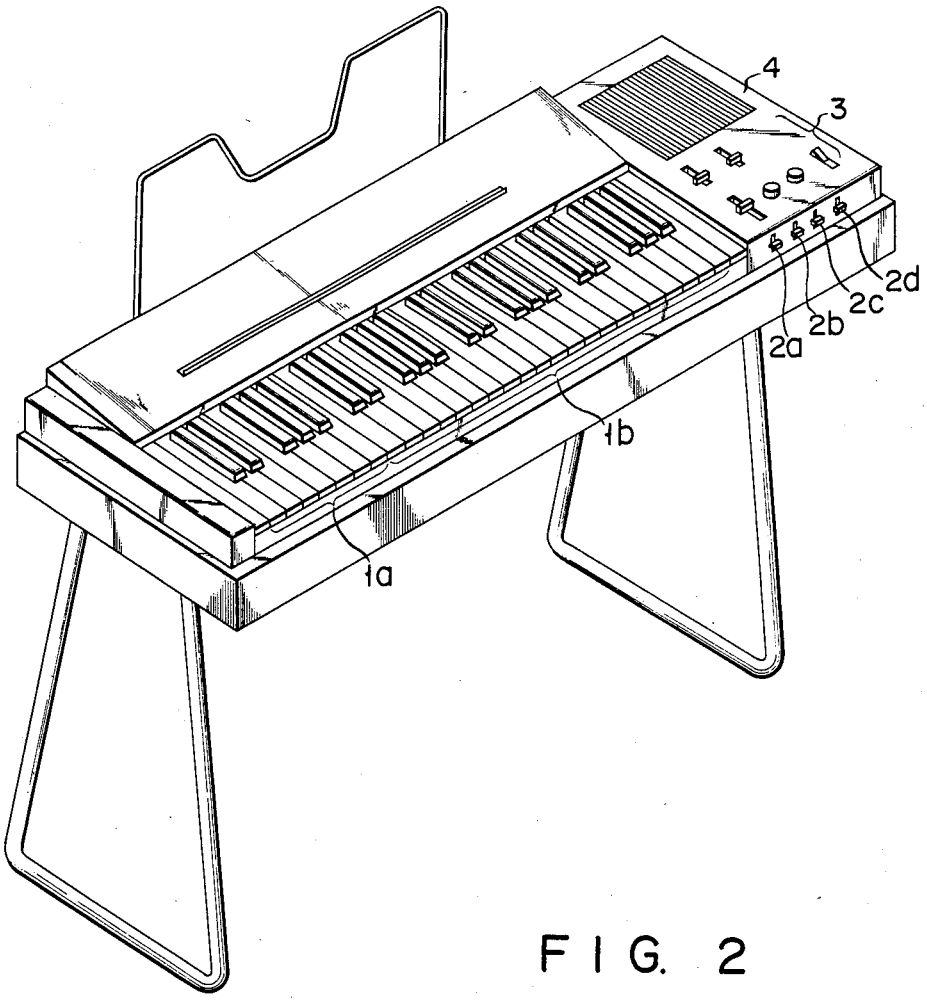
FIG. 1 perspectively illustrates an external view of an electronic organ to which the present invention is applied.

Referring to FIG. 1, there is shown a perspective external view of an electronic organ according to a first embodiment of the present invention. In FIG. 1, reference numeral 1 designates a keyboard of four octaves. The keyboard 1 is constructed of a treble section 1*a* of one octave and a bass section 1*b* of three octaves, which are functionally divided as described later. Switches 2*a* to 2*d* are used for designating that the keyboard 1 is used in a normal state, it is used in the functionally-divided state, or the data performed are written into either a first memory or a second memory, which are described in detail later. Reference numeral 3 generally designates external operation switches such as a power switch, a volume control and the like. Reference numeral 4 represents a loudspeaker.

Figure 2:
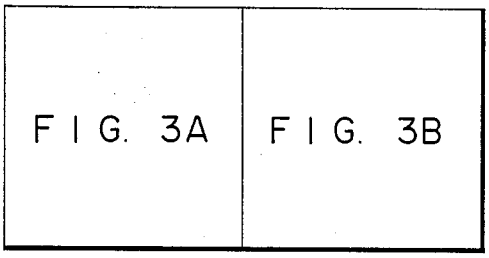
FIG. 2 illustrates how to couple the drawing in FIG. 3A with that in FIG. 3B.
Figure 3A:
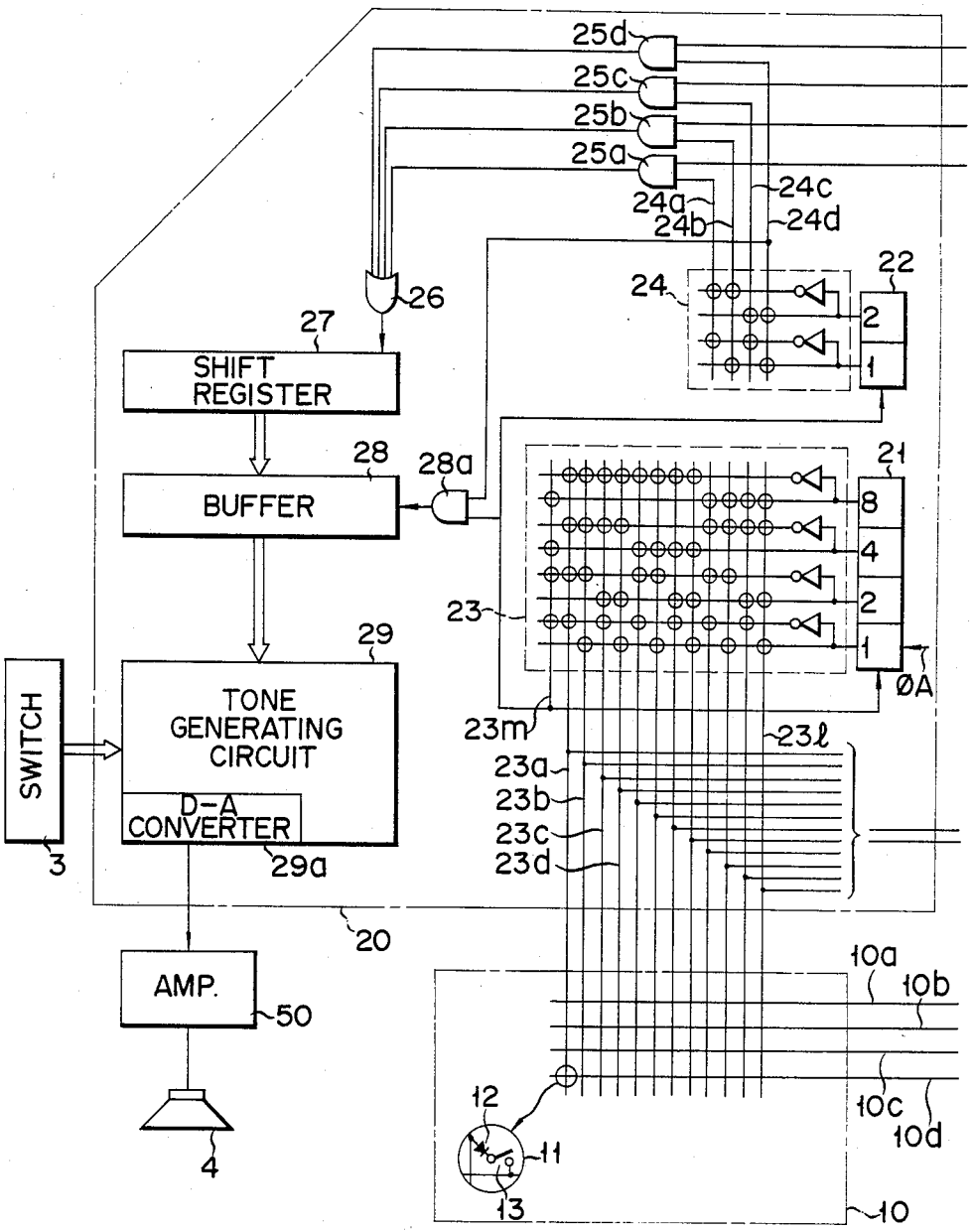
FIG. 3A shows a circuit arrangement commonly used for first to fourth embodiments of the musical instruments according to the present invention.
Figure 3B:
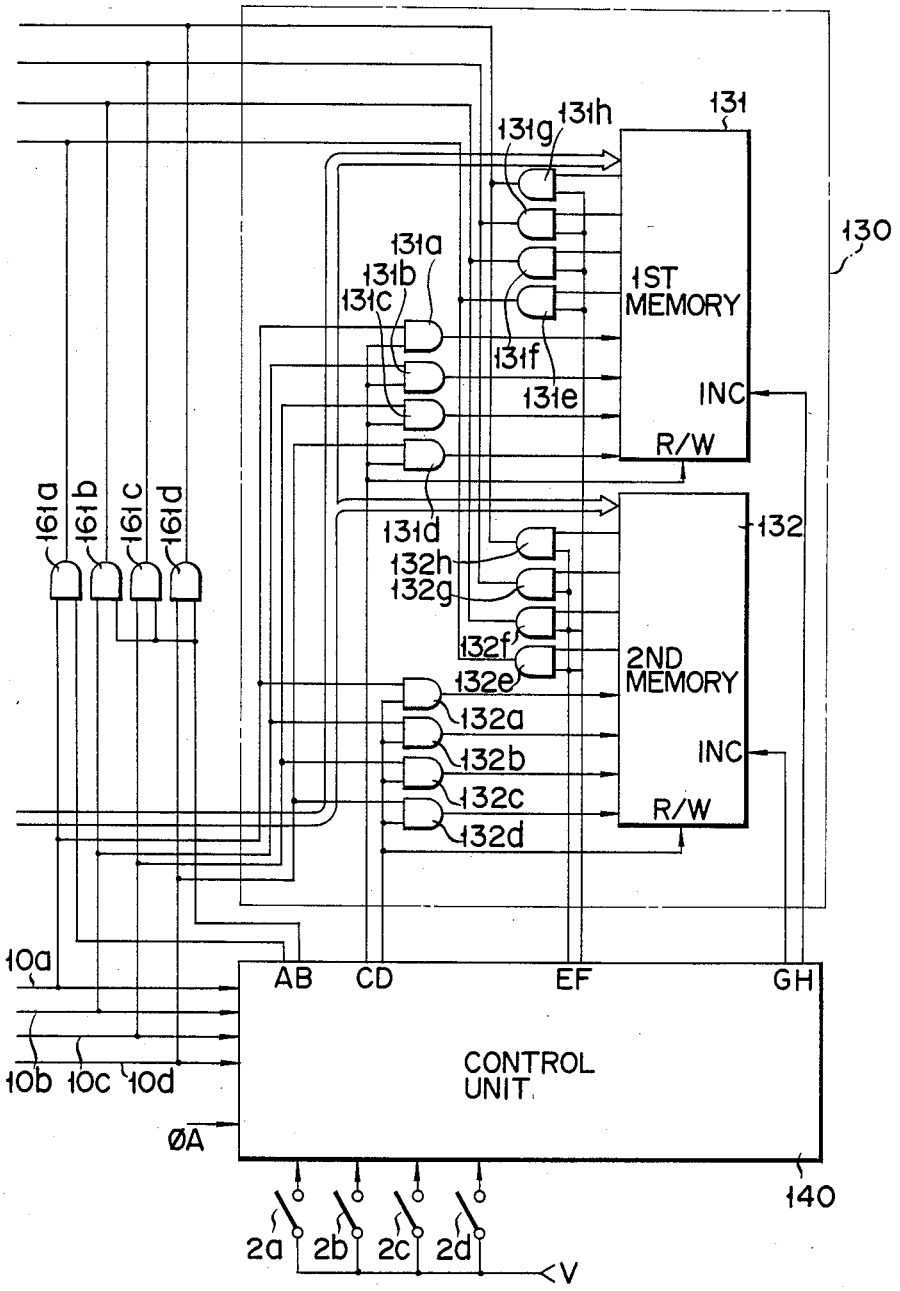
FIG. 3B shows a circuit arrangement of part of the first embodiment of the present invention.

A circuit arrangement of this embodiment of the present invention will be described referring to FIGS. 3A and 3B which are connected with each other, as shown in FIG. 2. The circuit arrangement shown in FIGS. 3A and 3B are comprised of five blocks and circuits for connecting these blocks. The blocks and circuits are fabricated by large scaled integrated circuits (LSIs) or hybrid ICs. Specifically, reference numeral 10 designates a key-in section operated by the respective keys on the keyboard 1; 20 a musical tone generating section including a circuit for forming a musical tone, a circuit for controlling a key-in operation, and the like; 130 a memory section including first and second memories 131 and 132 and their peripheral circuits; 140 a control section for controlling read and write operations for the memory section 30; 50 an amplifier. The first and second memories 131 and 132 are semiconductor memories of, for example, RAMs (random access memories).

The following explanation is an elaboration of those blocks 10 to 50 and their connecting circuits.

The tone generating section 20, as previously stated, includes a 4-bit note counter 21 and a 2-bit block counter 22 for scanning the keyboard 1 and detecting a depressed key or keys. A clock signal $\phi$A for the scanning is provided at the first stage of the note counter 21. The note counter 21 delivers the contents thereof to a note decoder 23. The note decoder 23 produces at different timings one-shot signals through 12 lines 23*a* to 23*l* corresponding to 12 pitches "C to B" in accordance with the counts "0 to 11" of the note counter 21. With the one-shot signals produced, the note decoder 23 scans the same pitch or tone names in the respective octaves of the key-in section 10. An output signal appears on a line 23*m* of the note decoder 23 when the contents of the note counter 21 reaches "12". The output signal on the line 23*m* is applied as a reset signal to the note counter 21 and as a count clock to the block counter 22. The block counter 22 counts in response to the count clock to produce an output signal which in turn is applied to a block decoder 24. In accordance with the count "0 to 3" of the block counter 22, the block decoder 24 produces different timing signals through lines 24*a* to 24*d*. The signals, after passing through the lines 24*a* to 24*d*, are applied, as octave detecting signals, to AND gates 25*a* to 25*d*, respectively. The output signals from the AND gates 25*a* and 25*d* are applied through an OR gate 26 to a shift register 27 which has a capacity of 48 bits corresponding to the number of keys in the key-in section 10 and has a serial-parallel converting function. The shift register 27 has bit positions corresponding to the keys in the key-in section 10 to store the data of the depressed keys. The parallel output signals from the shift register 27 are applied to a buffer 28 having the same capacity, i.e. 48 bits, as that of the shift register 27. When all the keys in the key-in section 10 are scanned, the output signals from the shift register 27 are loaded into the buffer 28. For this reason, the buffer 28 has a read signal as the output signal from an AND gate 28*a* which is coupled at the inputs with the output signals delivered through a line 23*m* of the note decoder 23 and a line 24*d* of the block decoder 24. The output from the buffer 28 is transferred to a tone generating circuit 29 for generating various tone signals. The tone generating circuit 29 digitally forms various tone signals in accordance with the pitches at the keys. The musical tone signals digitally formed by the circuit 29 are applied to a digital to analog (D-A) converting circuit 29*a* where they are converted into corresponding analog signals which in turn are amplified by an amplifier 50 and then are sounded by a loudspeaker 4. The output from the switch 3 is applied to the musical tone generating circuit 29 which generates given musical tone signals in accordance with the output signals from the buffer 28 and the switch 3.

The construction of each cross point of row and column lines of the key-in section 10, as indicated in detail by a circle 11, has the combination of a diode 12 and a switch 13 interlocking with each key of the keyboard 1. 48 switches of four octaves are combined to form a matrix of 4 rows and 12 columns. The column lines of the key-in section 10 are those extended from the lines 23*a* to 23*l* of the note decoder 23. Each column line is connected to the keys having the same tone names in different octaves, while each row line is connected to the keys corresponding to 12 pitches of "C to B". The key-in section 10 produces signals representing the key operations at the timings of the respective tone names through lines 10*a* to 10*d*.

Thus, the key operation signals delivered through the lines 10*a* to 10*d* are applied to AND gates 161*a* to 161*d*, respectively. The outputs from the AND gates 161*a* to 161*d* are applied to AND gates 25*a* to 25*d*, respectively. The key operation signals from the lines 10*a* to 10*d* are also inputted to the memory section 130. In the memory 130, the signals inputted are applied through AND gates 131*a* to 131*d* to a first memory 131 and through AND gates 132*a* to 132*d* to a second memory 132. The first and second memories 131 and 132 are also coupled with note codes delivered through the lines 23*a* to 23*l*.

The data read out from the first and second memories 131 and 132 are applied to AND gates 131*e* to 131*h* and AND gates 132*e* to 132*h*. The corresponding outputs of the gates 131*e* to 131*h* and 132*e* to 132*h* are wired and sent to the AND gates 25*a* to 25*d*. The AND gates 131*a* to 131*d*, 132*a* to 132*d*, 131*e* to 131*h* and 132*e* to 132*h* are switch-controlled by control signals C, D, F and E outputted from a control unit or section 140, respectively. The control section 140 additionally produces read/write control signals C and D for the first and second memories 131 and 132, and signals H and G for incrementing the addresses of the respective memories 131, 132 at the times of read and write.

In response to the output signals coming through the lines 10*a* to 10*d* of the key-in section 10 in connection with the switches 2*a* to 2*d* shown in FIG. 1, and the clock signal $\phi$A, the control section 140 produces the control signals C to H for the memory section 130 and the switch control signals A and B of the AND gates 161*a* and 161*b* to 161*d*. The detail of the control section 140 is illustrated in FIG. 4. The input and output terminals of a circuit diagram shown in FIG. 4 are not coincident in positional relation with those of the circuit shown in FIG. 3C.

The control section 140 has counters 1401 and 1402 which have constructions similar to those of the note counter 21 and the block counter 22, respectively. The count clock $\phi$A is applied to the first stage of the counter 1401. A signal which detects that the content of the counter 1401 reaches "12" is applied to the reset terminal of the counter 1401. The reset signal being applied to the counter 1401 is applied as a count clock signal to the counter 1402. The output of the counter 1402 is inputted to a decoder 1403 with the same construction as that of the block decoder 24. The key operation signals coming through the lines 10*a* to 10*d* are selected by a key timing detection circuit 1404 in response to the output signal from the decoder 1403 and the selected one is outputted through an OR gate 1405. Accordingly, the output signal from the OR gate 1405 includes the bit timings proper to the respective of all the keys. The key operation signal outputted from the OR gate 1405 is applied to AND gates 1406 and 1407 of which the outputs are applied through an OR gate 1408 to a shift register 1409 of 48-bit capacity. The output signal from the shift register 1409 is applied directly to the AND gate 1407 and through an inverter 1410 to the AND gate 1406. The AND gate 1406 produces an output when receiving an additional key operation signal. The AND gate 1407 produces an output signal when receiving the same key operation signal.

The parallel outputs from the shift register 1409 are transferred to a latch circuit 1412 when an AND gate 1411 for detecting that the content of the counter 1401 is "12" and the content of the counter 1402 is "3", that is to say, the scanning of all the keys is completed. In connection with the output of the latch circuit 1412, the lower 12 bits, i.e. the output signals from the bit positions of the latch circuit 1412 for storing the key operation signal appearing on the line 10*a*, are outputted from the latch circuit 1412 through an OR gate 1413 and an AND gate 1414, in the form of the gate control signal F for the AND gates 131*e* to 131*h*. The remaining bit signals are outputted from the latch circuit 1412 through an OR gate 1415 and an AND gate 1416, in the form of the gate control signal E for the AND gates 132*e* to 132*h*.

The AND gate 1406 produces a "1" signal when another key is depressed. The output from the AND gate 1406, together with the output signals (the control signals A and B) from inverters 1417 and 1418, which are inversions of the output signals from the switches 2*a* and 2*b*, is applied to an AND gate 1419. The output signal from the AND gate 1406 and the output signal from an OR gate 1422 for detecting that the content of the counter 1402 is "1 to 3" are applied to an AND gate 1420, together with the output signal from the switch 2*b*. The output signal from the AND gate 1406, the output signal produced from the OR gate 1422 when the counter 1402 produces a "0" signal, and the output signal from the switch 2*a* are applied to an AND gate 1421. The output signals from the AND gates 1419 and 1420 are applied to an OR gate 1423 which in turn produces an output signal as the increment signal G for the second memory 132. The output signals from the AND gates 1419 and 1421 are applied through an OR gate 1424 to the first memory 131, in the form of the increment signal H.

The output signal from the switch 2*c* is produced for the memory section 130 as the gate control signal for the AND gates 131*a* to 131*d* and the read/write signal for the first memory 131, which are denoted as C. The output signal from the switch 2*d* is produced as the control signal for the AND gates 232*a* to 232*d* and the read/write signal for the second memory 132, which are denoted as D.

Let us consider a case where, with such a construction, an accompaniment note is previously stored and in performing a musical piece, the first key group 1*a* is used for a read performance, while the second key group 1*b* for a manual performance, and under this condition, a melody is manually performed by using the second group keys 1*b*. Reference is made to FIGS. 5A and 5B and FIGS. 6A to 6F.

Figure 5A:
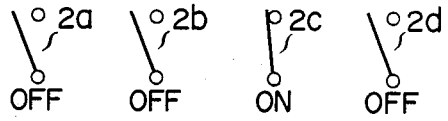
FIGS. 5A and 5B show an on-off state of switches for operating the electronic organ of the first embodiment of the present invention.
Figure 6A:
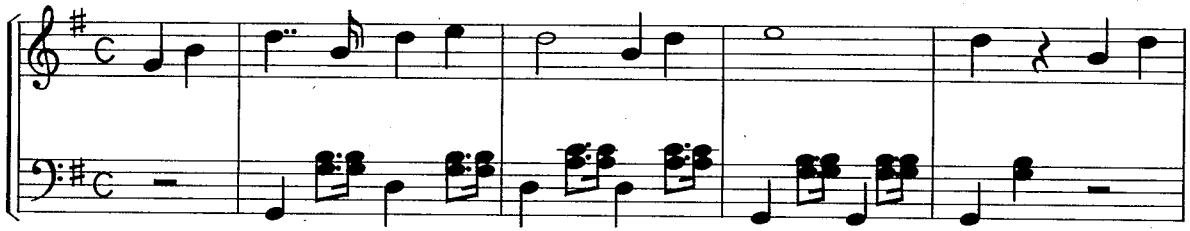
FIGS. 6A to 6F show a musical note of a musical piece and rhythm patterns of the operation of a key on the keyboard.
Figure 6B:
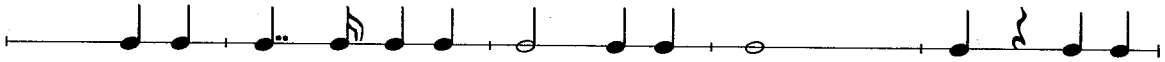
Figure 6C:
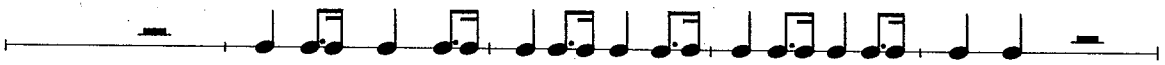
Figure 6D:
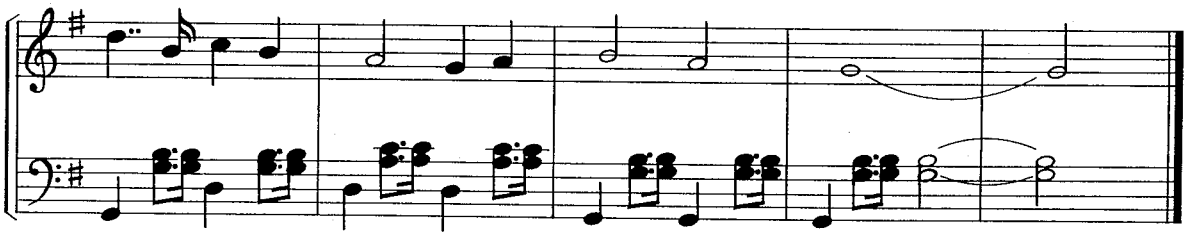

For storing the accompaniment note, the key group 1*a* is used for the read performance key group and the switch 2*c* is turned ON to enable the AND gates 131*a* to 131*d* whereby the accompaniment note is loaded into the first memory 131. Actually, the accompaniment note as shown in FIGS. 6A and 6D is loaded into the memory by operating the keyboard 1. At this time, because of ON state of the switch 2*c*, a write signal is applied to the memory 131, and the AND gates 131*a* to 131*d* are in an enabled state. When a key representing the first tone name "G2" is operated, the key operation signal produced by its key operation is produced onto the line 10*a* at the note timing of "G". The output signal on the line 10*a* is applied to the memory 131 via the AND gate 131*a*. At the same time, the note code outputted onto the lines 23*a* to 23*e* is applied to the memory 131 At this time, the signal on the line 10*a* is produced from the OR gate 1405 at the timing proper to the tone "G2". And the AND gate 1406 produces an output signal for the reason that "1" had been absent in the bit position of the tone "G2" up to that time. Since at this time the switches 2*a* and 2*b* are both in the "OFF" state, as shown in FIG. 5A, the increment signal H is applied as a write-in command into the memory 131, via the AND gate 1419 and the OR gate 1424. In response to the write-in command, the memory 131 stores the note code delivered through the lines 23*a* to 23*l* and the block code outputted from the AND gates 131*a* to 131*d*. The first memory 131 counts the number of the outputtings of the code of "B" in the note code outputted through the lines 23*a* to 23*l*. The same thing is true for the second memory 132. The codes inputted during a period that all of the keys of C2 to B5 are scanned are stored in the memory, as those to simultaneously be sounded. In this case, however, only the code of "G2" is stored. Accordingly, when the keys "G3, B3" are then operated, these "G3, B3" are stored as those to simultaneously be sounded, through an operation similar to the above-mentioned one. In accordance with the accompaniment note shown in FIGS. 6A and 6D, "G3, B3", "D3", "G3, B3", "G3, B3", . . . are successively operated, so that the accompaniment shown in FIGS. 6A and 6D is stored in the memory 131.

Figure 5B:
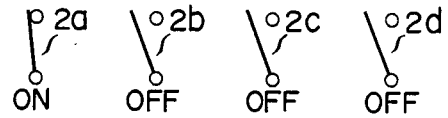

Explanation will be given about a case where the accompaniment data thus stored is read out, the explanation considering only the rhythm pattern and the melody note shown in FIGS. 6A and 6D is performed by the right hand. In this case, the switch 2C, which has been in ON state, as shown in FIG. 5B, is turned to the OFF side and the switch 2*a* to the ON side. Upon the setting of those switches, the AND gates 161*b* to 161*d* may be enabled but the AND gate 161*a* is never enabled by the operation of the first key group 1*a*. Accordingly, the first key group 1*a* is set to the key group for reading out the accompaniment stored in the memory 131.

Firstly, the first melody pitch "G4" is keyed in by the right hand. Upon the depression of the "G4" key, a key operation signal appears on the line 10*c* in the key-in section 10 and is applied to the AND gate 25*c*, through the AND gate 161*c* which may be enabled at this time. Since an octave detection signal is applied from the block decoder 24 to the AND gate 25*c*, via the line 24*c*, when the line 24*c* is selected, that is to say, the content of the block counter 22 becomes "2", the operation signal of the "G4" is loaded into the shift register 27, through the AND gate 25*c* and the OR gate 26. Subsequently, it is shifted in the shift register 27. A signal inputted into the shift register 27, when the output signal is produced from the AND gate 28*a*, that is, when all the keys in the key-in section 10 are scanned completely, is read into the buffer 28. In accordance with the data read into the buffer 28, the tone generating circuit 29 forms a tone of the pitch "G4" which is then sounded by the loudspeaker 4.

When the second melody tone "B4" is keyed in, a musical tone corresponding to the "B4" is formed by the tone generating circuit 29 through an operation similar to the above-mentioned one and is sounded similarly.

Then, for keying in the next melody tone "D5", a key of the "D5" is depressed by the right hand while one of the keys in the first key group 1*a* is depressed by the left hand. As a result of the key depressions, the sounding of the tone "D5" keyed in by the right hand is made as in the previous case. The depression of the given key of those in the first key group 1*a* causes a key operation output signal to appear on the line 10*a*. As a result, the OR gate 1405 produces an output signal at any one of the timings of tones "C2 to B2" which in turn is loaded into the shift register 1409 by way of the AND gate 1406. The AND gate 1421 is enabled under a condition that when the output is produced from the AND gate 1406 when the content of the counter 1402 is "0", and the switch 2*a* is ON. After the AND gate 1421 is enabled, the address increment signal H is transferred to the first memory 131. The contents of the shift register 1409 are transferred in parallel to the latch circuit 1412. Since the data latched in the latch circuit 1409 are any one of the tones "C2 to B2", an output signal is produced from the OR gate 1412 and enables the AND gates 131*e* to 131*h* through the AND gate 1414 which is enabled when the switch 2*a* is ON. The contents of the shift register 1409 is recirculated through the AND gate 1407, so that so long as the same key is depressed, the signal is continuously stored at the same position. Accordingly, as long as the key is depressed, the AND gate 1414 continuously produces the musical tone corresponding to the key depressed.

The first memory 131 responds to the increment signal H applied thereto through the OR gate 1424 to compare the note code on the lines 23*a* to 23*l* of the note decoder 23 with the note code previously stored. When both the note codes are coincident with each other, it produces a "1" signal to the lines specified by the block code. In the present case, the pitch firstly stored is "G2". Accordingly, when the note code of the "G" is outputted onto the lines 23*a* to 23*l*, the first memory 131 produces an output signal which is in turn applied to the AND gate 25*a* by way of the AND gate 31*h*. Therefore, two tones "G2" and "D5" are simultaneously formed in the musical tone generating or forming circuit 29 and are sounded by the loudspeaker 4.

Figure 6E:
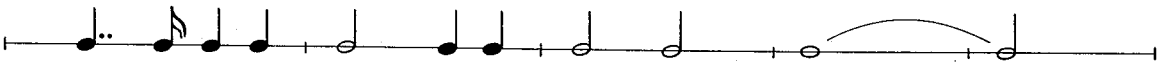
Figure 6F:
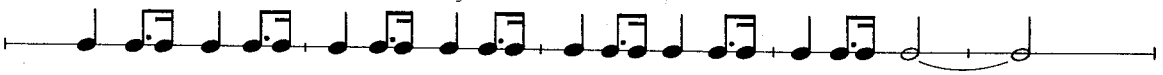

Subsequently, the melody in the melody note shown in FIGS. 6A and 6D is keyed in by the right hand while any one of the keys of the first key group 1*a* is depressed by the left hand to provide the rhythm pattern as shown in the rhythm note shown in FIGS. 6C and 6F. As a result, the musical tone forming circuit 29 forms the musical tones with the pitches as described in the musical note shown in FIG. 4 to sound them by the loudspeaker 4.

In the above-mentioned embodiment, the switch 2*c* is turned ON in the write mode and the switch 2*a* is turned ON in the performance mode, for the read and write of the accompaniment. Alternatively, the 2*d* is turned ON in the write mode and the switch 2*b* is turned ON for the read and write of the melody and the second key group 1*b* is used for the key group for the read. In this case, the accompaniment as shown in FIGS. 6A and 6D is performed by using the first key group 1*a* by the left hand. Any one of the keys of the second key group 1*b* is operated by the right hand in accordance with the rhythm pattern as shown in FIGS. 6B and 6E, thereby to read out the contents of the second memory 132.

In the first embodiment, one octave is assigned for the first key group and three octaves are assigned for the second key group. The keyboard 1 may be divided by a proper ratio of the octaves and is not limited to that of the above-mentioned embodiment.

As described above, the elecronic organ of the first embodiment previously stored either of the accompaniment or the melody. In the read mode, any one of the keys of one of the key groups obtained by functionally dividing the keyboard 1 with a given octave ratio is operated in accordance with the rhythm pattern of the accompaniment or the melody. Therefore, even a beginner can play difficult music in a simple manner, as described in the musical note.

The electronic organ according to the second embodiment of the present invention will be described hereinafter. The external view of the second embodiment of the electronic organ is substantially the same as that of FIG. 1, except that the switch 2*d* is not used. The keyboard 1 of the present embodiment is also divided into the key groups 1*a* and 1*b*. The switches 2*a* to 2*c* are used for designating that the keyboard 1 is used in a normal state, it is used in the functionally-divided state, or the musical data performed are written into either of the first or second memory to be described later.

Figure 3C:
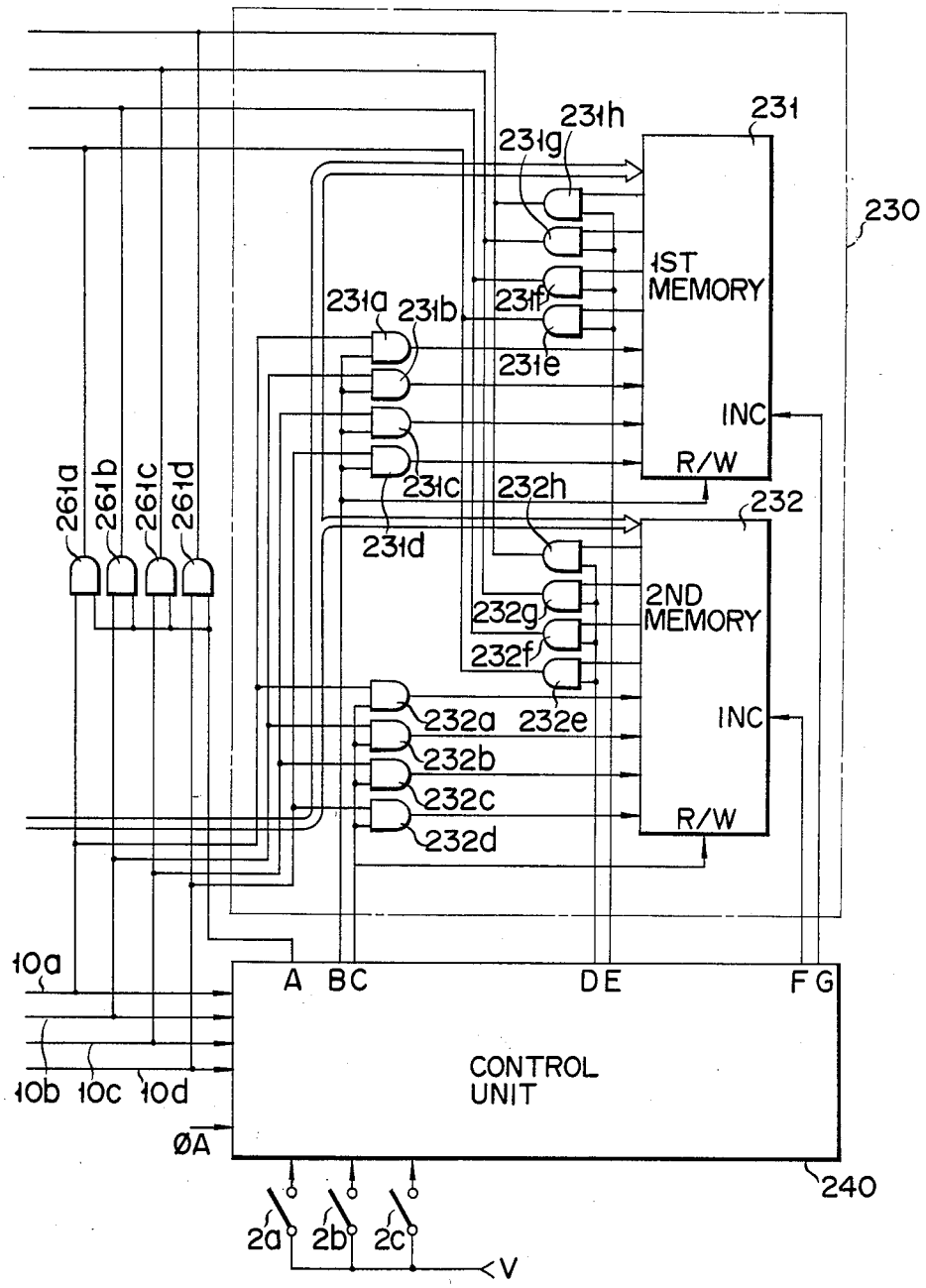
FIG. 3C shows a circuit diagram of a circuit arrangement of part of the second embodiment according to the present invention.
Figure 4:
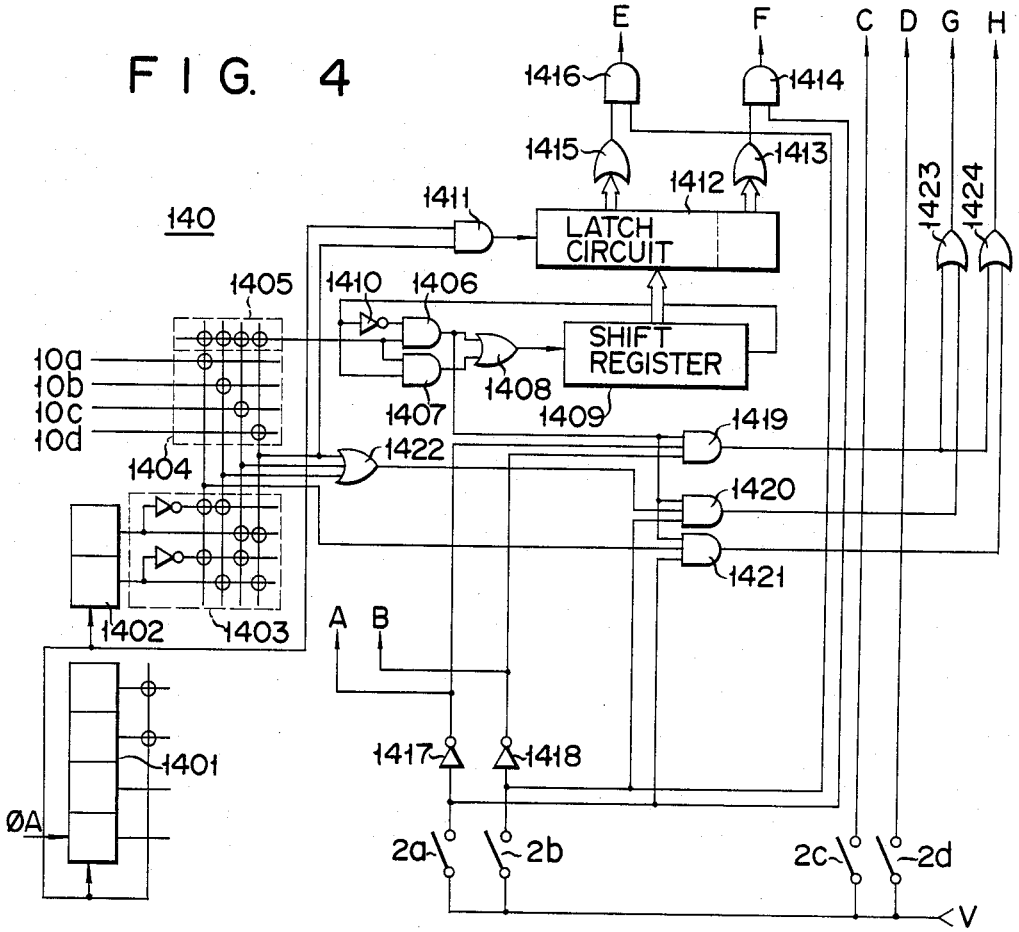
FIG. 4 shows a circuit arrangement of a control section used in the circuit shown in FIG. 3B.
Figures 7, 8:
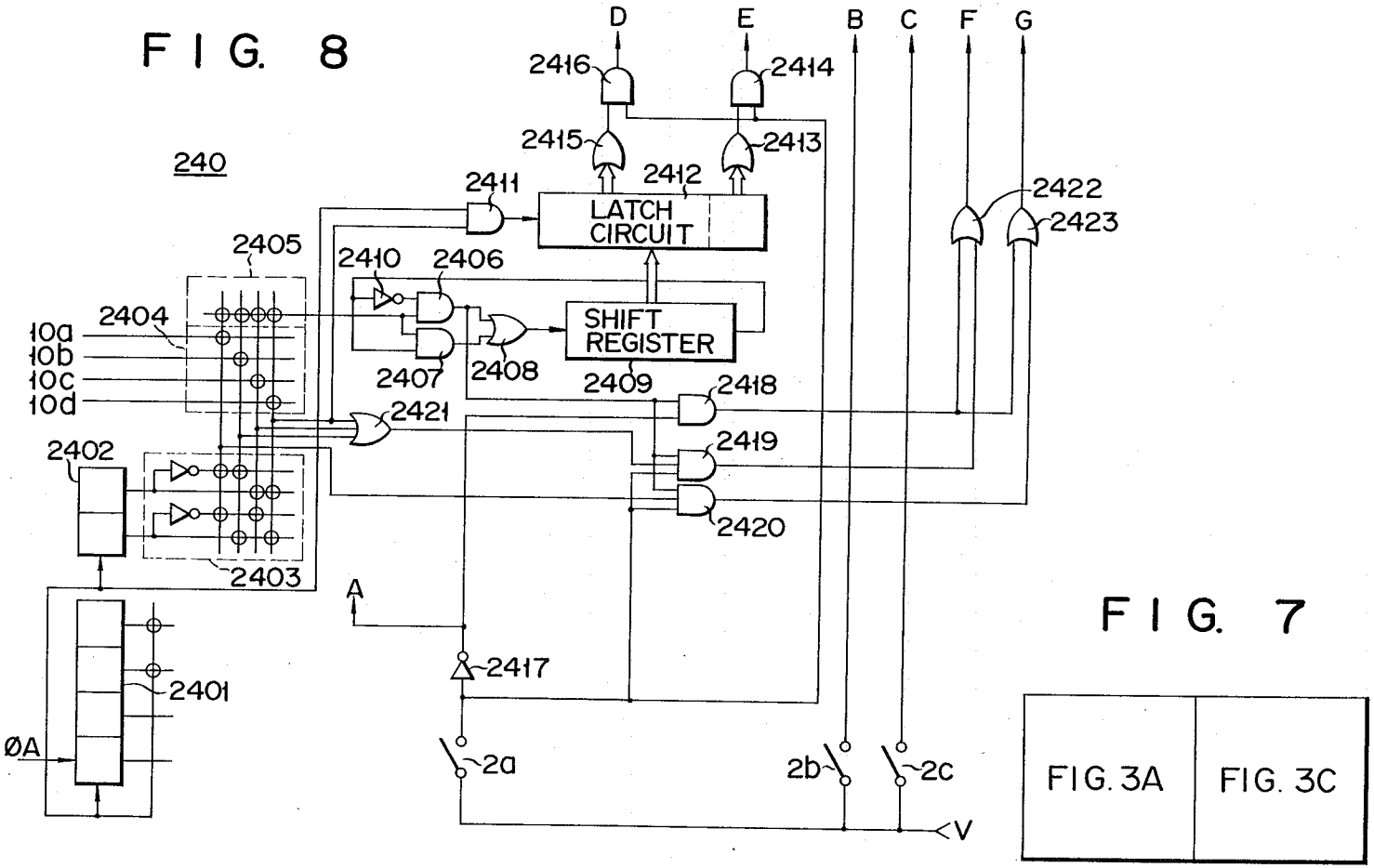
FIG. 7 illustrates how to couple the drawing shown in FIG. 3A with a drawing shown in FIG. 3C which cooperate to form the second embodiment according to the present invention.
FIG. 8 shows a detailed circuit diagram of a control section of the circuit shown in FIG. 3C.

The circuit arrangement of the present embodiment is comprised of the circuits shown in FIGS. 3A and 3C in an arrangement as shown in FIG. 7. The construction and operation of the circuit shown in FIG. 3A has been described in detail in the explanation of the first embodiment. Therefore, the description of the circuit of FIG. 3A will be omitted. The present embodiment has also five blocks and circuits for connecting these blocks. The five blocks are a key-in section 10, a musical tone generating or forming section 20, a memory section 230 including a first memory and a second memory, and their peripheral circuits, a control section 240 for transmitting control signals to the memory section 30 and the like, and an amplifier 50.

The key operation signal outputted from the key-in section 10 through the lines 10*a* to 10*d* is applied to AND gates 261*a* to 261*d* of which the outputs are applied to the AND gates 25*a* to 25*d*. The key operation signal outputted through the lines 10*a* to 10*d* are applied to a memory section 230. The signals entering the memory section 230 are applied through AND gates 231*a* to 231*d* to the first memory 231 and through AND gates 232*a* to 232*d* to the second memory 232. The musical note code outputted to the lines 23*a* to 23*l* is applied to the first and second memories 231 and 232.

The data read out from the first and second memories are outputted through AND gates 231*e* to 231*h*, and AND gates 232*e* to 232*h*. Of those signals from the gates, the corresponding ones are wired and are applied to the AND gates 25*a* to 25*d*. The AND gates 231*a* to 231*d*, 232*a* to 232*d*, 231*e* to 231*h* and 232*e* to 232*h* are switch-controlled by the control signals B, C, E and D outputted from the control section 240. Further, the control section 240 produces R/W (read/write) control signals B and C for the first and second memories 231 and 232, and increment signals G and F for incrementing the addresses of the respective memories 231 and 232 in the read and write modes.

Supplied with the output signals from the switches 2*a* to 2*c*, the output signals delivered through the lines 10*a* to 10*d* of the key-in section 10, and the clock signal $\phi$A, the control section 240 produces the control signal A for the AND gates 261*a* to 261*d* in addition to the control signals B to G for the memory section 230. The detail of the control section 240 is illustrated in FIG. 8. The input and output terminals of the circuit shown in FIG. 8 are not coincident in positional relation with those of the circuit shown in FIG. 3C.

The control section 240 has counters 2401 and 2402 which have constructions similar to those of the note counter 21 and the block counter 22, respectively. The count clock $\phi$A is applied to the first stage of the counter 2401. A signal which detects that the content of the counter 2401 reaches "12" is applied to the reset terminal of the counter 2401. The reset signal being applied to the counter 2401 is applied as a count clock signal to the counter 2402. The output of the counter 2402 is inputted to a decoder 2403 with the same construction as that of the block decoder 24. The key operation signals coming through the lines 10*a* to 10*d* are selected by a key timing detection circuit 2404 in response to the output signal from the decoder 2403 and the selected one is outputted through an OR gate 2405. Accordingly, the output signal from the OR gate 2405 includes the bit timings proper to each of all the keys. The key operation signal outputted from the OR gate 2405 is applied to AND gates 2406 and 2407 of which the outputs are applied through an OR gate 2408 to a shift register 2409 of 48-bit capacity. The output signal from the shift register 2409 is applied directly to the AND gate 2407 and through an inverter 2410 to the AND gate 2406. The AND gate 2406 produces an output when receiving an additional key operation signal. The AND gate 2407 produces an output signal when receiving the same key operation signal.

The parallel outputs from the shift register 2409 are transferred to a latch circuit 2412 when an AND gate 2411 for detecting that the content of the counter 2401 is "12" and the content of the counter 2402 is "3", that is to say, the scanning of all the keys is completed. In connection with the output of the latch circuit 2412, the lower 12 bits, i.e. the output signals from the bit positions of the latch circuit 2412 for storing the key operation signal appearing on the line 10*a*, are outputted from the latch circuit 2412 through an OR gate 2413 and an AND gate 2414, in the form of the control signal E for the AND gates 231*e* to 231*h*. The remaining bit signals are outputted from the latch circuit 2412 through an OR gate 2415 and an AND gate 2416, in the form of the control signal D for the AND gates 232*e* to 232*h*.

The AND gate 2406 produces a "1" signal when another key is depressed. The output from the AND gate 2406, together with the output signal (the control signal A) from inverter 2417, which is an inversion of the output signal from the switch 2*a*, is applied to an AND gate 2418. The output signal from the AND gate 2406 and the output signal from an OR gate 2421 for detecting that the content of the counter 2402 is "1 to 3" are applied to an AND gate 2419, together with the output signal from the switch 2*a*. The output signal from the AND gate 2406, the output signal produced when the counter 2402 produces a "0" signal, and the output signal from the switch 2*a* are applied to an AND gate 2420. The output signals from the AND gates 2418 and 2419 are applied to an OR gate 2422 which in turn produces an output signal as the increment signal F for the second memory 232. The output signals from the AND gates 2418 and 2420 are applied through an OR gate 2423 to the first memory 131, in the form of the increment signal G.

The output signal from the switch 2*b* is produced for the memory section 130 as the control signal for the AND gates 231*a* to 231*d* and the read/write signal for the first memory 131, which are denoted as B. The output signal from the switch 2*c* is produced as the control signal for the AND gates 232*a* to 232*d* and the read/write signal for the second memory 232, which are denoted as D.

Let us consider a case with such a construction, the accompaniment note shown in FIGS. 6A and 6D is stored in the first memory 231, the melody note shown in FIGS. 6A and 6D is stored in the second memory 232, and in performing a musical piece, any one of the first key group 1*a* is used for an accompaniment performance, while any one of the second key group 1*b* for a melody performance.

Figure 9A:
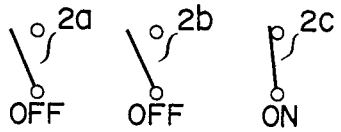
FIGS. 9A to 9C show an on-off state of switches for operating the electronic organ according to the second embodiment of the present invention.

For storing the melody note shown in FIGS. 6A and 6D, the switches 2*a* and 2*b* are turned OFF while the switch 2*c* is turned ON, as shown in FIG. 9A. Actually, the pitch codes are loaded into the second memory 232 by operating the keyboard 1. At this time, because of ON state of the switch 2*c*, the second memory 232 is in a ready-for-write condition. When a key representing the first tone "G4" is operated for storing the "G4" data, the key operation signal produced by its key operation is sent onto the line 10*c* at the timing of "G". The output signal in the line 10*c* is applied to the second memory 132 via the AND gate 232*c* which has been enabled by the ON of the switch 2*c*. At this time, the signal on the line 10*c* is produced from the OR gate 2405 at the timing proper to a pitch "G4". And the AND gate 2406 produces an output signal. Since at this time the switch 2*a* is in the "OFF" state, the output signal from the AND gate 2406 applies the increment signal F into the second memory 232, via the AND gate 2418 and the OR gate 2422. In response to the increment signal F, the second memory 232 stores the note code at that time and the block code outputted through the AND gates 232*a* to 232*d*. The second memory 232 counts the number of the outputtings of the code of "B" in the note code outputted through the lines 23*a* to 23*l*. The same thing is true for the first memory 231. The codes inputted during a period that all of the keys C2 to B5 are scanned are stored in the memory, as those to simultaneously be sounded. In this case, however, only the code of "G4" is stored. Accordingly, when a key of "B4" is then operated, the "B4" data are stored through an operation similar to the above-mentioned one. In accordance with the melody note shown in FIGS. 6A and 6D, keys of "D5", "B4", "D5", "E5", . . . are successively operated, so that the melody pattern shown in FIGS. 6A and 6D is stored in the memory 131.

Figure 9B:
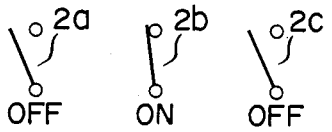

For storing the accompaniment note, the switches 2*a* and 2*c* are turned OFF, as shown in FIG. 9B while the switch 2*b* is turned ON. Under this switch condition, the keyboard 1 is operated for storing that. At this time, the first memory 231 is in the ready-for-storing state since the switch 2*b* is ON. When a key representing the first tone "G2" is operated, the key operation signal produced by its key operation is sent onto the line 10*a* at the note timing of the tone "G". The output signal on the line 10*a* is applied to the memory 231 via the AND gate 231*a*. At the same time, the note code outputted onto the lines 23*a* to 23*l* is applied to the memory 231. At this time, the signal on the line 10*a* is produced from the OR gate 2405 at the timing proper to a tone "G2". And the AND gate 2406 produces an output signal. Since at this time the switch 2*a* is in "OFF" state, the increment signal G is applied as a read command into the memory 231, via the AND gate 2418 and the OR gate 2423. In response to the write command, the memory 231 stores the note code delivered through the lines 23*a* to 23*l* and the block code outputted from the AND gates 231*a* to 231*d*. Then, when the keys of the tones "G3, B3" are then operated, data of these tones "G3, B3" are stored as those to simultaneously be sounded, through an operation similar to the above-mentioned one. In accordance with the accompaniment note shown in FIGS. 6A and 6D, tone keys "G3, B3", "D3", "G3, B3", "G3, B3", . . . are successively operated, so that the accompaniment shown in FIGS. 6A and 6D is stored in the memory 231.

Figure 9C:
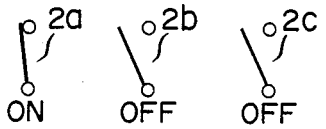

Explanation will be given about a case where the melody and the accompaniment thus stored are read out, the explanation considering only that the rhythm pattern and the melody is played by depressing any one of the keys of the second key group 1*b* by single finger of the right hand while the accompaniment is played by depressing any one of the keys of the first key group 1*a* whereby the music piece previously stored in the first and second memories 231 and 232 is played. In this case, the switch 2*a* is turned ON and the switches 2*b* and 2*c* are turned OFF, as shown in FIG. 9C. Upon the setting of those switches, the AND gates 261*a* to 261*d* are not enabled. The first key group 1*a* and the second key group 1*b* are set to the key groups for reading out the accompaniment and the melody stored in the first and second memories 231 and 232.

In performing the music piece, the first two notes of the melody of the musical note shown in FIGS. 6A and 6D are not accompanied by the accompaniment. Accordingly, any one of the keys of the second key group 1*b* is depressed by the right hand. The output signal appearing on any one of the lines 10*b* to 10*d* of the key-in section 10, as a result of the key operation, does not pass through the AND gates 261*a* to 261*d* and provides the increment signal F to the second memory 232, through the AND gates 2406 and 2419 and the OR gate 2422. In response to signals inputted, the second memory 232 compares the note code outputted onto the lines 23*a* to 23*l* of the note decoder 23 with the note code "G" previously stored. When those are coincident with each other, the memory 232 produces an output signal and applies it to the AND gate 225*e* via the AND gate 232*f* in accordance with the block code previously stored (in the present case, the one stored is "G4" and therefore it belongs to the third octave).

The output of the AND gate 2406 is loaded into the shift register 2409 via the OR gate 2408. The contents of the shift register 2409 is transferred in parallel to the latch circuit 2412. The data transferred to the latch circuit 2412 is the one corresponding to any one of the keys of the second key group 1*b*. For this reason, the OR gate 2415 produces a "1" signal which in turn is applied through the AND gate 2416 to the AND gates 232*e* to 232*h* thereby to enable them. The contents of the shift register 2409 is recirculated through the AND gate 2407, so that so long as the same key is depressed, the signal is continuously stored at the same position. Accordingly, so long as the key is depressed, the AND gate 2416 continuously produces an output signal.

An octave detection signal is applied from the block decoder 24 to the AND gate 25*c*, through the line 24*c*. When the line 24*c* is selected, that is, when the content of the block counter 22 becomes "2", the operation signal of the tone "G4" is written into the shift register 27 via the OR gate 26. Subsequently, it is shifted in the shift register 27. An input signal inputted to the shift register 27, when the output signal is produced from the AND gate 28*a*, that is, when all the keys in the key-in section 10 are scanned completely, is written into the buffer 28. In accordance with the data stored into the buffer 28, the tone generating circuit 29 forms a tone of the "G4" which is then sounded by the loudspeaker 4.

For sounding the second note of the melody, any one of the keys of the second key group 1*b* is depressed, so that through the operation similar to the above-mentioned one, the tone generating circuit 29 forms a musical tone with the pitch corresponding to the tone "B4".

For producing the next melody note, any one of the keys of the second key group 1*b* is depressed by the right hand while any of the keys of the first key group 1*a* is depressed by the left hand. As a result of the key depressions, the sounding caused by the key operation output signal by the second key group 1*b* is made as in the previous case. The depression of the given key of those in the first key group 1*a* causes a key operation output signal to appear on the line 10*a*. The output signal provides the increment signal G for commanding the read operation to the first memory 231, by way of the OR gate 2405, the AND gates 2406 and 2420, and the OR gate 2423. Upon receipt of the signal G, the first memory 231 compares the note code outputted to the lines 23*a* to 23*l*, of the note decoder 23 with the note code previously stored. When those are coincident with each other, the memory 231 produces a "1" signal in accordance with the previously stored block code, which in turn is applied to the AND gates 231*e* to 231*h*. In the present case, the pitch firstly stored in "G2". Therefore, when the note code "G" is produced onto the lines 23*a* to 23*l*, the memory 231 produces an output signal. The output signal produced from the memory 231 is applied to the AND gate 25*a* via the AND gate 231*h*. The operation similar to that in the read mode of the second memory 232 is performed.

The key operation output signal on the line 10*a* which is loaded into the shift register 2409 and transferred to the latch circuit 2412, is applied through the OR gate 2413 and the AND gate 2414 to the AND gates 231*e* to 231*h*. As a result, the operation similar to that in the read mode from the second memory 232 is performed.

Therefore, the musical tone generating circuit 29 simultaneously forms the two tones "G2" read out from the first memory 231 and "D5" read out from the second memory 232, which the tones are then sounded by the loudspeaker 4.

Subsequently, any one of the keys of the second key group 1*b* is operated by the right hand in accordance with the rhythm described in the rhythm note shown in FIGS. 6B and 6E. Similarly, any one of the keys of the first key group 1*a* is operated by the left hand in accordance with the rhythm described in the rhythm note shown in FIGS. 6C and 6F. As a result, the musical tone generating circuit 29 forms musical tones with pitches as described in the musical note shown in FIGS. 6A and 6B, which are then sounded by the loudspeaker.

In the above-mentioned embodiment, one octave is assigned for the first key group and three octaves are assigned for the second key group. The keyboard 1 may be divided by a proper ratio of the octaves and is not limited to that of the above-mentioned embodiment.

As described above, the electronic organ of the second embodiment previously stores both the accompaniment data and the melody data. In the read mode, any one of the keys of each key group obtained by functionally dividing the keyboard 1 with a given octave ratio is operated in accordance with the rhythm pattern of the accompaniment and the melody. Therefore, even a beginner can play difficult music in a simple manner, as described in the musical note.

The electronic organ according to the third embodiment of the present invention will be described hereinafter. The external view of the third embodiment of the electronic organ is substantially the same as that of FIG. 1. In the present embodiment, the switches 2*c* and 2*d* are not used and the switch 2*a* is of four-contact type and the switch 2*b* is of two-contact type. The keyboard 1 of the present embodiment is also divided into the key groups 1*a* and 1*b*. The switches 2*a* and 2*b* are used for designating that the keyboard 1 is used in a normal state, it is used in the functionally-divided state, the tone data performed is written into either of the first or second memory to be described later, or the data written is read out.

Figure 3D:
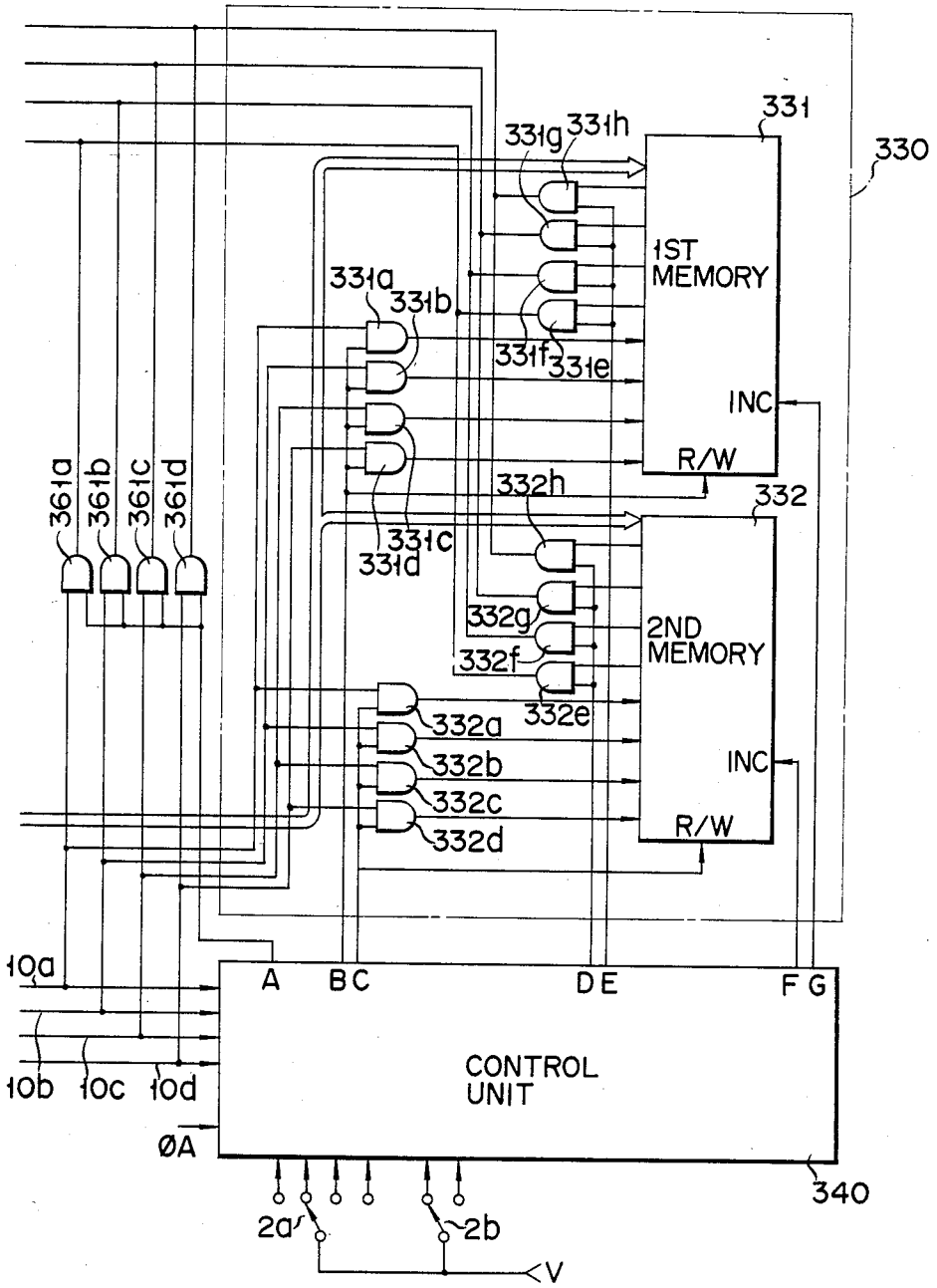
FIG. 3D shows a circuit diagram of part of a circuit configuration of the third embodiment of the present invention.
Figure 10:
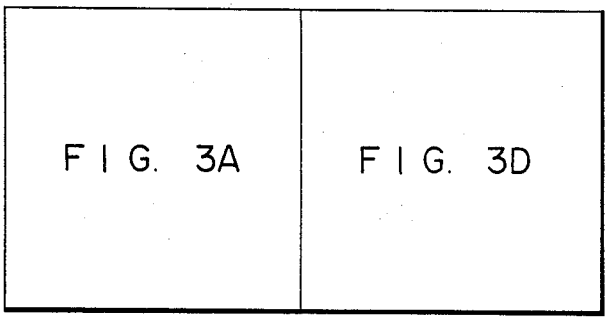
FIG. 10 shows how to couple the drawing shown in FIG. 3A with that shown in FIG. 3D.

The circuit arrangement of the present embodiment is comprised of the circuits shown in FIGS. 3A and 3D in an arrangement as shown in FIG. 10. The construction and operation of the circuit shown in FIG. 3A was described in detail in the paragraph of the first embodiment. Therefore, the description of the circuit of FIG. 3A will be omitted. The present embodiment has also five blocks and circuits for connecting those blocks. Those five blocks are a key-in section 10, a musical tone generating or forming section 20, a memory section 330 including a first memory 331 and a second memory 332, and their peripheral circuits, a control section 340 for transmitting control signals to the memory section 330 and the like, and an amplifier 50.

The key operation signal outputted from the key-in section 10 through the lines 10*a* to 10*d* is applied to the AND gates 361*a* to 361*d* of which the outputs are applied to the AND gates 25*a* to 25*d*. The AND gates 361*a* to 361*d* are controlled in their operation by an output signal A outputted from the control section 340 to be described later. The AND gates 361*a* to 361*d* control whether or not the key operation signals outputted onto the lines 10*a* to 10*d* of the key-in section 10 are inputted into the musical tone generating section 20.

The key operation signals outputted through the lines 10*a* to 10*d* are applied to the memory section 330. The signals entering the memory section 330 are applied through AND gates 331*a* to 331*d* to the first memory 331 and through AND gates 332*a* to 332*d* to the second memory 332. The AND gates 331*a* to 331*d* and 332*a* to 332*d* are supplied with control signals B and C outputted from the control circuit 340 to be described later. Further, the control circuit 340 applies the control signals B and C as R/W (read/write) signals to the first and second memories 331 and 332. The reason why the memories 331 and 332 are provided in the memory section 330, is that the accompaniment or the melody must previously be stored in the first or the second memory so as to enable a player to read out for performance of the musical piece by the key operation of the key-in section 10. Those two memories may be combined into a single memory by using an additional simple circuit.

The first and second memories 331 and 332 are supplied with signals G and F from the control circuit 340, which are used for incrementing an address setting circuit provided in the memory and for designating the read or write mode.

A 12-bit signal outputted through the lines 23*a* to 23*l* from a note decoder 23 is inputted as a note identifying signal to the memories 331 and 332. A note code outputted onto the lines 23*a* to 23*l* and a block code outputted from the AND gates 331*a* to 331*d* or 332*a* to 332*d* are written into the memories 331 and 332.

Figure 11:
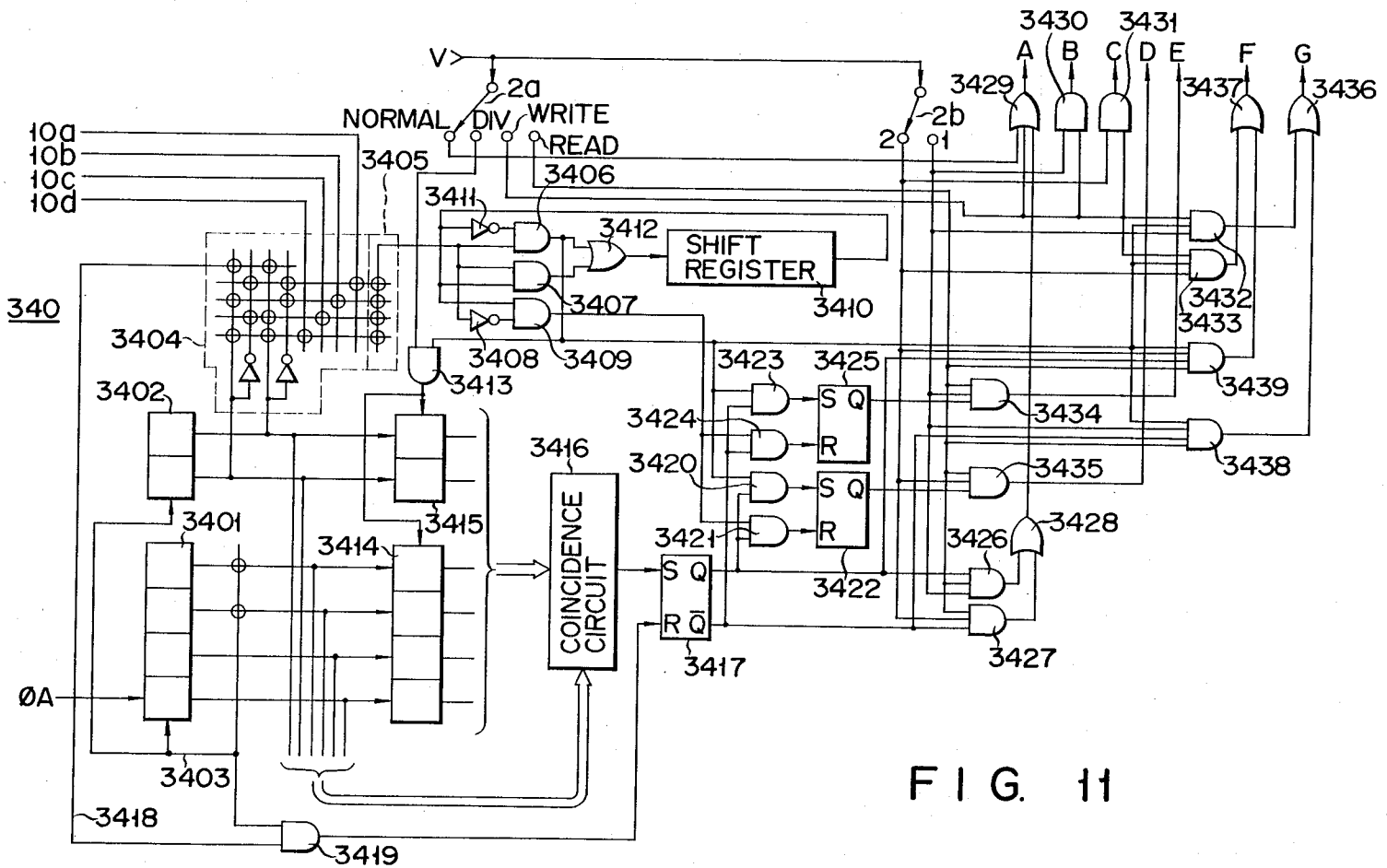
FIG. 11 shows a circuit diagram of a detailed control section of the circuit shown in FIG. 3D.

Supplied with the key operation signals delivered through the lines 10*a* to 10*d* of the key-in section 10, the clock signal $\phi$A and the output signals from the switches 2*a* and 2*c*, the control section 340 produces control signals B and C for controlling the switching operation of the AND gates 331*a* to 331*d* and 332*a* to 332*d* and for designating the read and write for the memories 331 and 332, increment signals G and F for the memories 331 and 332, a switch control signal E for the AND gates 331*e* to 331*h*, and a switch control signal D for the AND gates 332*e* to 332*h*. The detail of the control section 340 is illustrated in FIG. 11. The input and output terminals of the circuit shown in FIG. 11 are not coincident in positional relation with those of the circuit shown in FIG. 3D.

In FIG. 11 counters 3401 and 3402 operate in synchronism with the note counter 21 and the block counter 22 shown in FIG. 3A, respectively. The count clock $\phi$A, which is similar to that applied to the note counter 21, is applied to the first stage of the counter 3401. The counter 3401 is reset by a signal outputted onto a line 3403 when the content of the counter 3401 reaches "12". The reset signal outputted onto a line 3403 is applied as a count clock to the counter 3402. The output of the counter 3402 is inputted to a key-on detector 3404. The key operation signals coming through the lines 10*a* to 10*d* are octave-selected as by the AND gates 25*a* to 25*d* and the selected one is outputted through an OR gate 3405. The key operation signal outputted from the OR gate 3405 is directly applied to AND gates 3406 and 3407 and through an inverter 3408 to the AND gate 3409. The output signal from a shift register 3410 of a 48-bit capacity is applied through an inverter 3411 to the AND gate 3406, and is directly applied to AND gates 3407 and 3409. Those AND gates 3406, 3407 and 3409 produce "1" signals when another key is operated, the key operation is continued, and the key operation is stopped. The output signals from the AND gates 3406 and 3407 are applied through an OR gate 3412 to the shift register 3410. The output signal from the AND gate 3406, together with the output signal from a division designating contact of the switch *2a*, is applied to an AND gate 3413. The output signal from the AND gate 3413 is applied as a write command signal to the memories 3414 and 3415 for storing the contents of the counters 3401 and 3402. The memories 3414 and 3415 store the position data of a key when the contact of the switch *2a* is at the division designating position, in the form of a note code and a block code by fetching the contents of the counters 3401 and 3402 operating in synchronism with the note counter 21 and the block counter 22. The output signals from those memories, together with the output signals from the counters 3401 and 3402, are applied to a coincident circuit 3416. The coincident circuit 3416 compares the data outputted from the counters 3401 and 3402 with the code outputted from the memory 3414 or 3415. When those are coincident with each other, the circuit 3416 applies the coincident signal to the set terminal S of an R-S flip-flop 3417. Applied to the reset terminal R of the R-S flip-flop 3417 is an output signal obtained when output signals appearing on the lines 3418 and 3403 when the content of the counter 3402 becomes "3" are applied to an AND gate 3419. The output signal at the set output Q of the R-S flip-flop 3417 is applied to AND gates 3420 and 3421 to which the output signals from the AND gates 3406 and 3409 are further applied. The output signals from the AND gates 3420 and 3421 are applied to the set terminal S and the reset terminal R of an R-S flip-flop 3422. The output signal at the reset output $\overline{Q}$ of the R-S flip-flop 3417 is applied to AND gates 3423 and 3424 to which the output signals from the AND gates 3406 and 3409 are further applied. The output signals from the AND gates 3423 and 3424 are applied to the set terminal S and the reset terminal R of an R-S flip-flop 3425, respectively.

The output signal at the set output Q of the R-S flip-flop 3417 is applied to an AND gate 3426 and the output signal at the reset terminal $\overline{Q}$ to an AND gate 3427. The AND gate 3426 is further supplied with an output signal from the contact of the switch *2a* for designating the read from the first and second memories 331 and 332 and the output signal from a first contact of the switch *2b*. The AND gate 3427 is supplied with the output signal from a contact of the switch *2a* for directing the read and the output signal from a second contact of the switch *2b*. The output signals from the AND gates 3426 and 3427 are applied through an OR gate 3428 to an OR gate 3429.

The OR gate 3429 is further supplied with the output signal from a contact of the switch *2a* for designating a normal performance and the output signal from a contact for designating the write into the first and second memories 331 and 332. The output signal from the OR gate is applied as a switching control signal A to the AND gates 361*a* to 361*d*.

The output signal from the write designating contact of the switch *2a* is applied to AND gates 3430 and 3433. The output signal from the read designating contact of the switch *2a* is applied to AND gates 3434, 3435, 3438 and 3439. The output signals from the first and second contacts of the switch *2b* are applied to the AND gates 3430 and 3431*f* which the output signals are outputted in the form of a gate control signal for the AND gates 331*a* to 331*d* and an R/W control signal B of the first memory 331, and a gate control signal for the AND gates 332*a* to 332*d* and an R/W control signal C for the second memory 332.

The output signal at the set output Q of the R-S flip-flop 3425 and the output signal from the first contact of the switch *2b* are further applied to the AND gate 3434 of which the output is applied as a switch control signal E to the AND gates 331*e* to 331*h*. The output signal at the set output Q of the flip-flop 3422 and the output signal from the second contact of the switch *2b* are further applied to the AND gate 3435 of which the output is applied as a switch control signal D to the AND gates 332*e* to 332*h*.

The output signal from the AND gate 3406 is commonly applied to the AND gates 3432 and 3433 to which the output signal from the first and second contacts of the switch *2b* are applied, respectively. The output signal from the AND gate 3432 is transferred to an OR gate 3436 and the output signal from the AND gate 3433 to an OR gate 3437. Further applied to the OR gate 3436 are the output signal of the AND gate 3406, the output signal from the read designating contact of the switch *2a*, the output signal from the first contact of the switch *2b*, and the output signal of the AND gate 3438 to which the output signal at the reset output $\overline{Q}$ of the R-S flip-flop 3417 is applied. Further applied to the OR gate 3437 are the output signal from the read designating contact of the switch *2a*, the output signal from the second contact of the switch *2b*, and the output signal of the AND gate 3439 to which the output signal at the set output Q of the R-S flip-flop 3417 is applied. The output signal from the OR gate 3436 serves as an increment signal G for the first memory 331 while that of the OR gate 3437 serves as an increment signal F for the second memory 32.

Explanation will be given of a case where of four octaves of the keyboard, the lowest octave, i.e. a group of keys C2 to B2, is used for the read performance, an accompaniment is previously stored in the memory and is read out therefrom by operating any one of the keys of the key group C2 to B2 (this key group will be referred to as a first key group 1*a* and the remaining keys as a second key group 1*b* as shown in FIG. 1).

Figure 12A:
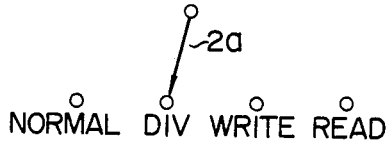
FIGS. 12A to 12C illustrate an on-off state of switches for operating the electronic organ according to the third embodiment of the present invention.

Since the first key group is used for the read performance, the switch *2a* is used for designating the keyboard division, as shown in FIG. 12A and a key "C3" is operated. As a result of the key operation, a key operation signal appears on the line 10*b* of the key-in section 10 at the timing "C" and is applied to the key-on detection circuit 3404 of the control section 340. Depending on the contents of the counter 3402, the key-on detection circuit 3404 produces a "1" signal onto a given line of the OR gate 3405. The result is that the AND gate 3406 produces a "1" signal and the AND gate 3413 produces a "1" signal, and that the contents of the counters 3401 and 3402 are written into the memories 3414 and 3415. Therefore, the coincident circuit 3416 by necessity produces a coincidence signal at the timing of C3 during the key scanning thereby to set the R-S flip-flop 3417.

Let us next consider a case where the accompaniment note shown in FIGS. 6A and 6D is previously stored in the memory, and in performing a music, it is read out for performance by operating any one of the keys of the first key group 1*a* and the melody is manually performed by operating the remaining keys, i.e. the keys of the second key group 1*b*.

Figure 12B:
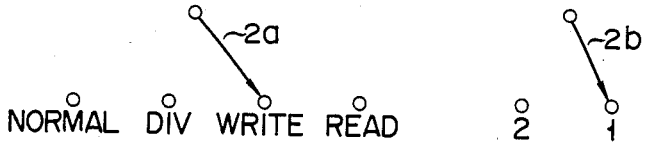

For storing the accompaniment note, the switch 2*a* is used for the write position designation, as shown in FIG. 12B and the switch 2*b* is set to the first contact so that it is stored into the first memory 331. The accompaniment shown in FIGS. 6A and 6D is written thereinto by operating the keyboard 1. At this time, the switch 2*a* is set to the write position designation and the switch 2*b* is set to the first contact. For this reason, a write signal is transferred from the AND gate 3430 to the first memory 331, so that the AND gates 331*a* to 331*d* are conditioned. Under this condition, a key of the first note "G2" is depressed. Upon the depression, a key operation signal is outputted into the line 10*a* at the note timing of "G". The output signal from the line 10*a* is applied through the AND gate 331*a* to the first memory 331, while at the same time a note code outputted into the lines 23*a* to 23*l* is applied to the first memory 331. The signal outputted into the line 10*a* at this time, is outputted from the OR gate 3405 at the timing proper to the note "G2", so that the AND gate 3406 produces a "1" signal because "1" had been absent up to that time in the bit position of the note "G2". Accordingly, the AND gate 3432 is fully conditioned to produce an output signal and an increment signal G is applied as a write command to the first memory, through the OR gate 3436. As a result, the note code outputted into the lines 23*a* to 23*l* and the block code outputted from the AND gates are written into the first memory 331. The first memory 331 counts the number of the outputtings of the code "B" of the note codes outputted into the lines 23*a* to 23*l*, and stores the code inputted during a period that all the keys of C2 to B5 are scanned, as those to be simultaneously be sounded. At present, only the code "G2" is stored therein. Then, when the keys of the notes "G3, B3" are operated, these notes "G3, B3" are stored as those to simultaneously be sounded, through an operation similar to the above-mentioned one. In accordance with the accompaniment note shown in FIGS. 6A and 6D, "G3, B3", "D3", "G3, B3", "G3, B3", . . . are successively operated, so that the accompaniment shown in FIGS. 6A and 6D is stored in the memory 331.

Figure 12C:
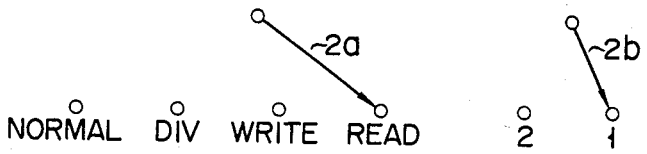

Explanation will be given about a case where the accompaniment thus stored are read out by considering only the rhythm pattern and the melody shown in FIGS. 6A and 6D is played by the right hand. In this case, the switch 2*a* is set to the read designation, as shown in FIG. 12C. The switch 2*b* is left unchanged. As a result of the setting of the keys and the above-mentioned keyboard separation designation, as the key timing of the first key group 1*a*, the output signal at the reset output $\overline{Q}$ of the R-S flip-flop 3417 is "1" while at the key timing of C3 to B5, the output signal at the set output Q is "1". Accordingly, when the first melody note "G4" is first played by the right hand, its key operation signal appears on the line 10*c* of the key-in section 10. At this time, the set output Q of the flip-flop 3417 is "1". Accordingly, the AND gate 3426 is fully conditioned, so that an enable signal A is applied from the OR gate 3429 to the AND gates 361*a* to 361*d*. Accordingly, the key operation signal is applied to the AND gate 25*c*, through the AND gate 361*c*. To the AND gate, there is delivered an octave detection signal from the block decoder 24 by way of the line 24*c*. For this reason, when the line 24*c* is selected, the content of the block counter 22 is "22", the key operation signal of the "G4" is loaded into the shift register 27, through the AND gate 25*c* and the OR 26. Then, it is successively shifted in the shift register. Accordingly, when the AND gate 28*a* produces an output signal, that is to say, when all the keys of the key-in section 10 are scanned, the signal inputted to the shift register 27 is loaded into the buffer 28. The musical tone generating circuit 29 forms a musical tone with a pitch of "G4" in accordance with the data loaded into the buffer 28, and sounds it by the loudspeaker 4.

When the second melody note "B4" is played, the musical tone generating circuit 29 forms a musical tone with a pitch corresponding to the note "B4" through an operation as mentioned above.

When the melody note "D5" is subsequently played, the key of the note "D5" is depressed by the right hand while any one of the keys of the first key group 1*a* is operated by the left hand. Accordingly, the sounding of the "D5" is made as in the previous case. However, when a given key of the first key group 1*a* is operated, the AND gate 3432 is fully conditioned since the R-S flip-flop 3417 is in a reset state at this time, with the result that the R-S flip-flop 3425 is rendered set state and its output provides an enable signal E through the AND gate 3434 to the AND gates 331*e* to 331*h*.

Concurrently, the AND gate 3432 is enabled to transfer an increment signal G to the first memory 331. Upon receipt of the increment signal G, the first memory 331 compares a note code outputted into the lines 23*a* to 23*l* of the note decoder 23 with the previously stored note code and, when it detects a coincidence between them, produces an output signal into the line defined by the previously stored block code. In this example, the pitch firstly stored is "G2". Accordingly, when the note code of "G" is outputted into the lines 23*a* to 23*l*, the first memory 331 produces an output signal which in turn is applied to an AND gate 25*a*. Accordingly, the musical tone generating circuit 29 simultaneously forms two sounds "G2" and "D5" and sounds it by the loudspeaker 4. Then, when the key operation by the left hand is stopped, the AND gate 3409 produces a "1" signal. At this time, since the signal at the reset output $\overline{Q}$ of the R-S flip-flop 3417 is "1", a reset signal is transferred to the R-S flip-flop 3425, through the AND gate 3432. Accordingly, the signal at the set output Q becomes "0" and the switch control signal for the AND gates 331*e* to 331*h* becomes "0", resulting in cease of the sounding of the musical tone "G2".

Subsequently, the melody in the melody note shown in FIGS. 6A and 6D is played by the right hand while any one of the keys of the first key group 1*a* is operated by the left hand in accordance with the rhythm pattern on the rhythm note shown in FIGS. 6C and 6E. The musical tone generating circuit 29 forms musical tones with pitches as described in the note and sounds them by the loudspeaker 4.

In the above-mentioned embodiment, the switch 2*b* is set to the first contact for the read and write of the accompaniment. Alternatively, the read and write of the melody may be performed by setting the switch 2*b* to the second contact. In this case, the left hand is used for performing the accompaniment by using the functionally-divided key group, i.e. the key group from a key of pitch C2 to a key of pitch which is separation-designated. On the other hand, the right hand operates the second key group 1*b* divided to read and perform the melody with the accompaniment shown in FIGS. 6B and 6E. In this case, although the operating circuitry is different from that of the above-mentioned case and the circuit operation is substantially equal to the above-mentioned one. Accordingly, the explanation of it will be omitted.

While the division position of the keyboard 1 is set to the key at the pitch C3, it may be at any pitch, as described above.

As described above, the electronic organ according to the third embodiment previously stores either the accompaniment or the melody and in the read mode, operates any of the keys in the key group functionally divided in accordance with the rhythm pattern of the accompaniment or the melody. Accordingly, even difficult music can be played by a beginner in a simple manner. Moreover, since the functional division of the keyboard may be set to any pitch or key position, a range of the pitches allowing the manual performance as well as the read performance may be properly adjusted.

The electronic organ according to the fourth embodiment of the present invention will be described hereinafter. The external view of the fourth embodiment of the electronic organ is substantially the same as that of FIG. 1. In the present embodiment, the switches 2*b* to 2*d* are not used and the switch 2*a* is of the five-contact type.

The keyboard 1 of the present embodiment is functionally divided at a proper key position, as will be described later. The switch 2*a* is used for designating that the keyboard 1 is used in a normal state, it is used in the functionally-divided state, the data performed are written into either of the first or second memory to be described later.

Figure 3E:
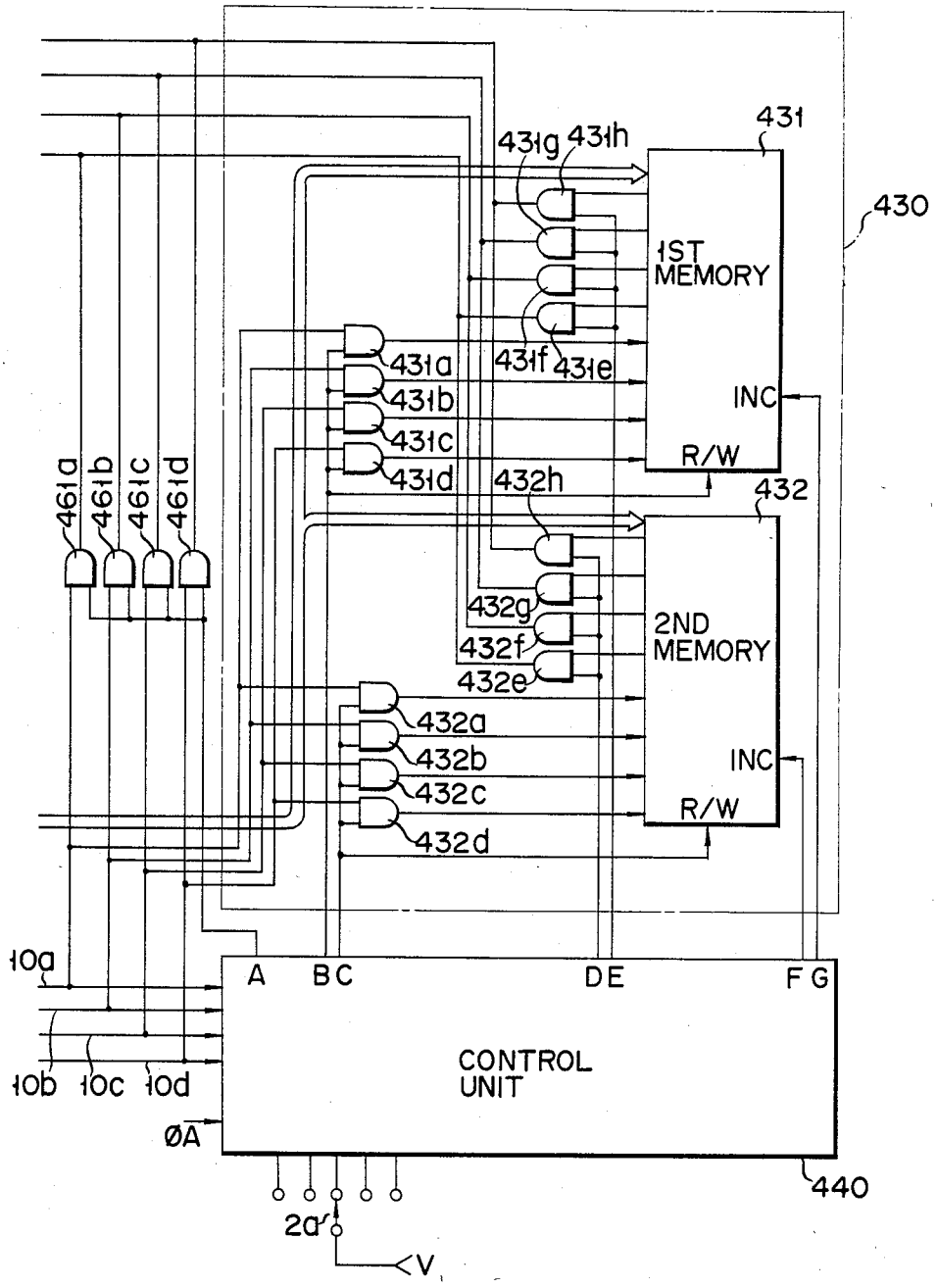
FIG. 3E shows a circuit diagram of part of a circuit configuration of the fourth embodiment according to the present invention.
Figure 13:
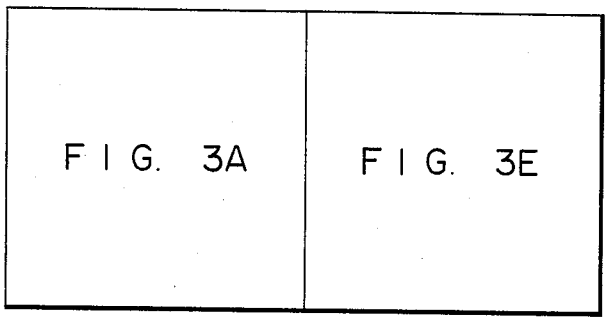
FIG. 13 shows how to couple the drawing shown in FIG. 3A with that shown in FIG. 3E.

The circuit arrangement of the present embodiment is comprised of the circuits shown in FIGS. 3A and 3E in an arrangement as shown in FIG. 13. The construction and operation of the circuit shown in FIG. 3A was described in detail in the paragraph of the first embodiment. Therefore, the description of the circuit of FIG. 3A will be omitted. The present embodiment has also five blocks and circuits for connecting those blocks. Those five blocks are a key-in section 10, a musical tone generating or forming section 20, a memory section 430 including a first memory 431 and a second memory 432, and their peripheral circuits, a control section 440 for transmitting control signals to the memory section 430 and the like, and an amplifier 50.

The key operation signal outputted from the key-in section 10 through the lines 10*a* to 10*d* is applied to the AND gates 461*a* to 461*d* of which the outputs are applied to the AND gates 25*a* to 25*d*. The AND gates 461*a* to 461*d* are switch-controlled by an output signal A outputted from the control section 440 to be described later. The AND gates 461*a* to 461*d* control whether or not the key operation signals outputted onto the lines 10*a* to 10*d* of the key-in section 10 are inputted into the musical tone generating section 20.

The key operation signals outputted through the lines 10*a* to 10*d* are applied to the memory section 430. The signals entered the memory section 430 are applied through AND gates 431*a* to 431*d* to the first memory 431 and through AND gates 432*a* to 432*d* to the second memory 432. The AND gates 431*a* to 431*d* and 432*a* to 432*d* are supplied with control signals B and C outputted from the control circuit 440 to be described later. Further, the control circuit 440 applies the control signals B and C as R/W (read/write) signals to the first and second memories 431 and 432. The reason why the memories 431 and 432 are provided in the memory section 430, is that the accompaniment and the melody must be stored in the first or the second memory through the key operation of the key-in section 10 by a player. Those two memories may be combined into a single memory by using an additional simple circuit.

The first and second memories 431 and 432 are supplied with signals G and F from the control circuit 440, which are used for incrementing the contents of an address setting circuit provided in the memory and for designating the read or write mode.

A 12-bit signal outputted through the lines 23*a* to 23*l* from a note decoder 23 is inputted as a note identifying signal to the memories 431 and 432. A note code outputted onto the lines 23*a* to 23*l* and a block code outputted from the AND gates 431*a* to 431*d* or 432*a* to 432*d* are written into the memories 431 and 432.

Figure 14:
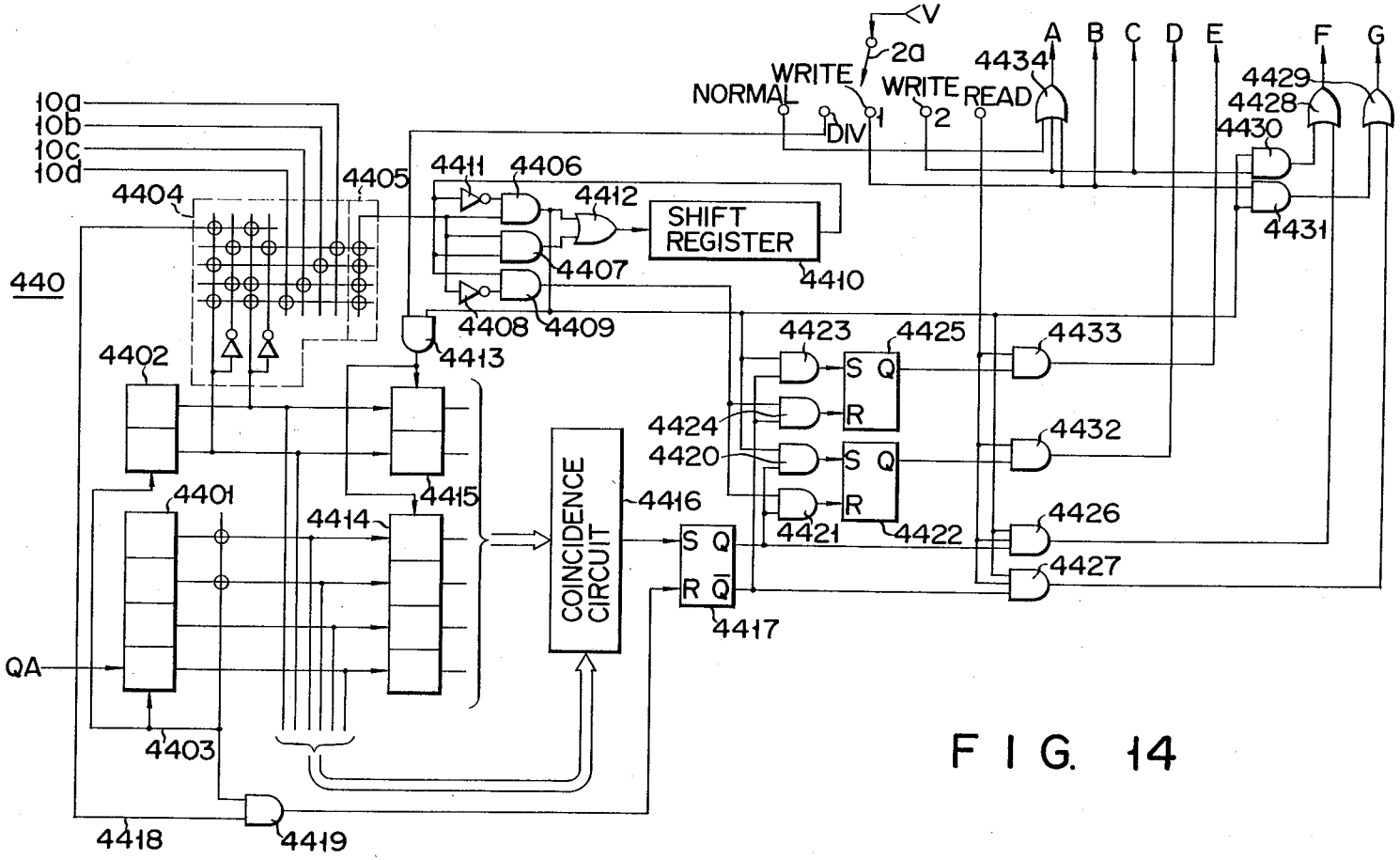
FIG. 14 shows a circuit diagram of a detailed control section shown in FIG. 3E.

Supplied with the key operation signals delivered through the lines 10*a* to 10*d* of the key-in section 10, the clock signal $\phi$A and the output signal from the switch 2*a*, the control section 440 produces control signals B and C for controlling the switching operation of the AND gates 431*a* to 431*d* and 432*a* to 432*d* and for designating the read and write for the first and second memories 431 and 432, increment signals G and F for the memories 431 and 432, a switch control signal E for the AND gates 431*e* to 431*h*, and a switch control signal D for the AND gates 432*e* to 432*h*. The detail of the control section 440 is illustrated in FIG. 14. The input and output terminals of the circuit shown in FIG. 14 are not coincident in positional relation with those of the circuit shown in FIG. 3E.

In FIG. 14, counters 4401 and 4402 operate in synchronism with the note counter 21 and the block counter 22 shown in FIG. 3A, respectively. The count clock $\phi$A, which is similar to that applied to the note counter 21, is applied to the first stage of the counter 4401. The counter 4401 is reset by a signal outputted onto a line 4403 when the content of the counter 4401 reaches "12". The reset signal outputted onto a line 4403 is applied as a count signal to the counter 4402. The output of the counter 4402 is inputted to a key-on detector 4404. The key operation signals coming through the lines 10*a* to 10*d* of the key-in section 10 are octave-selected as by the AND gates 25*a* to 25*d* and the selected one is outputted through an OR gate 4405. The key operation signal outputted from the OR gate 4405 is directly applied to AND gates 4406 and 4407 and through an inverter 4408 to the AND gate 4409. The output signal from a shift register 4410 of a 48-bit capacity is applied through an inverter 4411 to the AND gate 4406, and is directly applied to AND gates 4407 and 4409. Those AND gates 4406, 4407 and 4409 produce "1" signals when another key is operated, the key operation is continued, and the key operation is stopped. The output signals from the AND gates 4406 and 4407 are applied through an OR gate 4412 to the shift register 4410. The output signal from the AND gate 4406, together with the output signal from a division designation contact of the switch 2*a*, is applied to an AND gate 4413. The output signal from the gate 4413 is applied as a write command signal to the memories 4414 and 4415 for storing the contents of the counters 4401 and 4402. The memories 4414 and 4415 store the position data of a key operated when the switch 2*a* is at the division designating position, in the form of a note code and a block code by fetching the contents of the counters 4401 and 4402 operating in synchronism with the note counter 21 and the block counter 22. The output signals from those memories, together with the output signals from the counters 4401 and 4402, are applied to a coincident circuit 4416. The coincident circuit 4416 compares the data outputted from the counters 4401 and 4402 with the code outputted from the memory 4414 or 4415. When those are coincident with each other, the circuit 4416 applies the coincident signal to the set terminal S of an R-S flip-flop 4417. Applied to the reset terminal R of the R-S flip-flop 4417 is an output signal obtained when output signals appearing on the lines 4418 and 4403 when the content of the counter 4402 becomes "3" are applied to an AND gate 4419. The output signal at the set output Q of the R-S flip-flop 4417 is applied to AND gates 4420 and 4421 to which the output signals from the AND gates 4406 and 4409 are further applied. The output signals from the AND gates 4420 and 4421 are applied to the set terminal S and the reset terminal R of an R-S flip-flop 4422. The output signal at the reset output $\overline{Q}$ of the R-S flip-flop 4422 The output signal at the reset output $\overline{Q}$ of the R-S flip-flop 4417 is applied to AND gates 4423 and 4424 to which the output signals from the AND gates 4406 and 4409 are further applied. The output signals from the AND gates 4423 and 4424 are applied to the set terminal S and the reset terminal R of an R-S flip-flop 4425, respectively.

The output signal at the set output Q of the R-S flip-flop 4417 is applied to an AND gate 4426 and the output signal at the reset terminal Q to an AND gate 4427. The AND gates 4426 and 4427 are further supplied with an output signal from the contact of the switch 2*a* for designating the read from the first and second memories 431 and 432 and the output signal from the AND gate 4406. The AND gates 4246 and 4427 are applied to OR gates 4248 and 4249, respectively.

The OR gate 4428 is further supplied with the output signal from a contact of the switch 2*a* for designating the write into the second memory 432 and the output signal from the AND 4406. The OR gate 4429 is supplied with the output signal from the contact for designating the write into the first memory 431 and the output signal from the AND gate 4406. The output signals from the OR gates 4428 and 4429 are applied as increment signals F and G to the second and first memories 432 and 431.

The output signal at the set output Q of the R-S flip-flop 4422, together with the output from a contact for designating the read from the first and second memories 431 and 432, is applied to the AND gate 432. The output signal from the AND gate 4432 is applied as a switch control signal to the AND gates 432*e* to 432*h*. The output signal at the set output Q of the R-S flip-flop 4425, together with the output from a contact for designating the read from the first and second memories 431 and 432, is applied to the AND gate 4433 of which the output is applied as a switch control signal E to the AND gates 431*e* to 431*h*.

The control signal A outputted from the control section 440 is taken out from an OR gate 4434 supplied with a signal from a contact of the switch 2*a* for designating a normal performance, the output signal from a contact for designating the write into the first memory 431, and the output signal from a contact for designating the write to the second memory 432. The control signals B and C, respectively, are the output signal from a contact for designating the write into the first memory 431 and the output signal from a contact for designating the write into the second memory 432.

Explanation will be given of a case where of four octaves of the keyboard, the lowest-pitch octave, i.e. a group of keys C2 to B2 (referred to as a first key group 1*a*) is used for the accompaniment read performance and the keys B2 to B5 (referred to as a second key group 1*b*) for the melody read performance, and the contents of the first and second memories 431 and 432 are read out for such purposes.

Figure 15A:
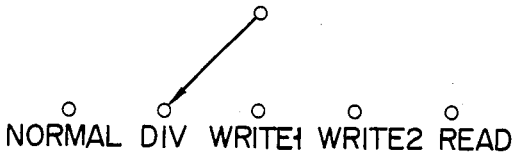
FIGS. 15A to 15D show an on-off state of switches for operating the electronic organ according to the fourth embodiment of the invention.

Firstly, for designating the division position in the keyboard, the switch 2*a* is set to the division contact position, as shown in FIG. 15A, and a key of "C3" is depressed. Through the key operation of the C3, a key operation signal appears on the line 10*b* of the key-in section 10 at the timing of "C". The key operation signal is applied to the key-on detection circuit 4404 of the control section 440. The key-on detection circuit 4404 provides a "1" signal onto a given line of the gate 405 in accordance with the contents of the counter 4402. As a result, the AND gate 4406 produces a "1" signal and the AND gate 4413 produces a "1" signal, so that the contents of the counters 4401 and 4402 are loaded into the memories 4414 and 4415. Accordingly, the coincidence circuit 4416 by necessity produces a coincidence signal at the timing of the C3 during the course of the scanning, thereby to set the R-S flip-flop 4417.

Explanation will be given of a case where the accompaniment note shown in FIGS. 6A and 6D is stored in the first memory 431 and the melody note shown in FIGS. 6A and 6D is stored in the second memory.

Figure 15B:
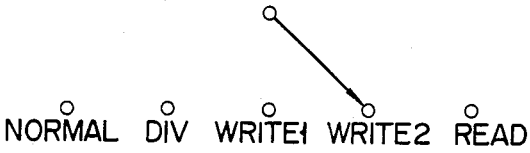

For storing the melody note shown in FIGS. 6A and 6D in the second memory 432, the switch 2*a* is set to the position for designating the write into the second memory 432, as shown in FIG. 15B, and the pitch codes thereof are written into the second memory 432 by operating the keyboard 1. At this time, the second memory 432 has been in a ready-for-write condition upon receipt of an enable signal for the AND gates 432*a* to 432*d*. For storing the first note "G4", the key of "G4" is operated to produce a key operation signal into the line 10*c* at the timing of "G" which is a note timing, which in turn is applied to the second memory 432 via the AND gate 432*c*. At this time, the signal outputted into the line 10*c* is outputted from the OR gate 4405 at the timing proper to the "G4". And the AND gate 4406 produces a "1" output signal for the reason that "1" had been absent in the bit position of the "G4" in the shift register 4410 till then. Therefore, the AND gate 4430 is fully conditioned to provide an increment signal F as a write command signal to the second memory 432 via the OR gate 428. As a result, the second memory 432 stores note codes outputted from the lines 23*a* to 23*l* and a block code outputted from the AND gate 32*a* to 32*d*. The second memory 432 counts the number of the outputtings of the code of "B" of the note codes outputted onto the lines 23*a* to 23*l*. The same thing is true for the first memory 431. The codes inputted during a period that all the keys C2 to B5 are scanned are stored in the memory as those to simultaneously be sounded. In this case, however, only the code of "G4" is stored. Accordingly, when a key of "B4" is then operated, the "B4" is stored through the operation similar to the above-mentioned one. In accordance with the melody note, shown in FIGS. 6A and 6D, "D5", "B4", "D5", "E5", . . . are successively operated, so that the melody pattern shown in FIGS. 6A and 6D is stored in the second memory 432.

Figure 15C:
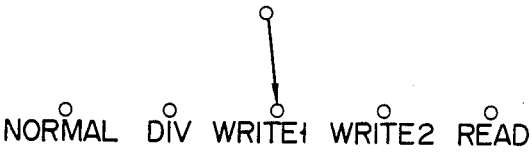

For storing the accompaniment note, the switch 2*a* is set to the position for designating the write into the first memory 431, as shown in FIG. 15C. Then, the keyboard 1 is operated to store the pitch codes into the first memory 431. At this time, the first memory 431 has been in the ready-for-write condition because of reception of an enable signal for the AND gates 431*a* to 431*d*. When the key of the first tone "G2" is operated, its key operation signal is outputted into the line 10*a* at the note timing of the "G" and the output signal from the line 10*a* is applied to the first memory 431 through the AND gate 431*a*. At the same time, the note codes outputted into the lines 23*a* to 23*l* are applied to the first memory 431. At this time, the signal outputted to the line 10*a* is obtained from the OR gate 4405 at the timing proper to the "G2" and the AND gate 4406 produces a "1" output signal because "1" had not been in the bit position of the "G2" in the shift register 4410 until then. Accordingly, the AND gate 431 is fully conditioned to apply an increment signal G as a write signal to the first memory 431 via the OR gate 4429. As a result, the first memory 431 stores note codes outputted into the lines 23*a* to 23*l* and a block code outputted from the AND gates 31*a* to 31*d*. Then, when the keys of the notes "G3, B3" are operated, these notes "G3, B3" are stored as those to simultaneously be sounded, through the operation similar to the above-mentioned one. In accordance with the accompaniment not shown in FIGS. 6A and 6D, "G3, D3", "D3", "G3, B3", "G3, B3", . . . are successively operated, so that the accompaniment shown in FIGS. 6A and 6D is stored in the first memory 431.

Figure 15D:
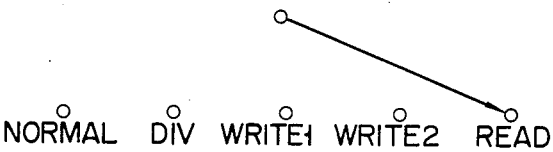

Let us next consider a case where the melody and the accompaniment thus stored in the first and second memories are read out and performed, by considering only the rhythm pattern, in a manner that any one of the keys in the second key group 1*b* is operated by a single finger of the right hand for the melody and any one of the keys in the first key group 1*a* is operated by a single finger of the left hand for the accompaniment. In this case, the switch 2*a* is set to a position for designating the read from the first and second memories 431 and 432, as shown in FIG. 15D. Upon the setting of the switch, the AND gates 461*a* to 461*d* are not enabled and the first and second key groups 1*a* and 1*b* are set to those keys for the accompaniment and melody stored in the first and second memories 431 and 432, respectively. Since the keyboard 1 is thus divided, the R-S flip-flop 4417 has at the reset output $\overline{Q}$ "1" at the key timings of C2 to B2 while it has at the set output Q "1" at the key timings C3 to B5.

In performing the musical piece shown in FIGS. 6A and 6D, the first two notes of the melody shown in the figures are not accompanied by the accompaniment. Accordingly, any one of the keys of the second key group 1*b* is operated by the right hand. Through the key operation, the output signal produced on the lines 10*b* to 10*d* in the key-in section 10 is supplied to the key-on detection circuit 4404 without passing through the AND gates 461*b* to 461*d*. Thus, at the timing, the set output Q of the R-S flip-flop 4417 has "1". Therefore, the logical condition of the AND gate 4420 is satisfied to render the R-S flip-flop 4422 the set state. The output signal thereof is transferred as a control signal D to the AND gates 432*e* to 432*h*, through the AND gate 4432.

Concurrently, the logical condition of the AND gate 4426 is satisfied to transfer an increment signal F through the OR gate 4428 to the second memory 432. In response to the increment signal F, the second memory 432 compares the note code outputted into the lines 23*a* to 23*l* of the note decoder 23 with the previously stored note code. When those are coincident with each other, it produces an output signal into the block code previously stored. In the present case, the pitch firstly stored in the second memory 432 is "G4". Therefore, it produces an output signal toward the line extending to the AND gate 25*c*.

Since an octave detection signal is applied from the block decoder 24 to the AND gate 25*c* by way of the line 24*c*, when the line 24*c* is selected, that is, when the content of the block counter 22 is "2", the key operation signal of the "G4" is loaded into the shift register 27 via the AND gate 25*c* and the OR gate 26 and it is successively shifted in the shift register When the AND gate 28*a* produces an output signal, that is, when all the keys of the key-in section 10 are completely scanned, the signal inputted into the shift register 27 is loaded into the buffer 28. The musical tone forming circuit 29 forms a musical tone with a pitch of the "G4" in accordance with the data loaded into the buffer 28, and sounds it with assistance of the loudspeaker 4.

When the key operation by the right hand is stopped, the AND gate 4409 produces a "1" signal at that timing. At the same time, a reset signal is transferred to the R-S flip-flop 4422 via the AND gate 4421 since the R-S flip-flop 4417 is in the set state. Accordingly, the set output Q of the flip-flop 4422 becomes "0" to stop the supply of an enable signal to the AND gates 432*e* to 432*h* and to stop the sounding of the musical tone "G4".

Then, when any one of the keys of the second key group 1*b* is operated for producing the second tone for the melody, the musical tone generating circuit 29 forms a musical tone with a pitch corresponding to the key "B4" through the operation as mentioned above.

For producing the melody note, the right hand operates any one of the keys in the second key group 1*b* while for the producing the accompaniment, the left hand operates any one of the keys in the first key group 1*a*. In this case, the sounding caused by the key operation of the second key group 1*b* is made as in the previous case. When a given key of the first key group 1*a* is operated, the AND gate 4423 is satisfied since the R-S flip-flop 4417 is in the reset state at that time. Therefore, the R-S flip-flop 4425 is set to produce an output signal as an enable signal to the AND gates 431*e* to 431*h*, through the AND gate 4433.

At the same time, the logical condition of the AND gate 4427 is satisfied to transfer an increment signal G to the first memory 431. Upon receipt of the increment signal, the first memory 431 compares the note code outputted into the lines 23*a* to 23*l* of the note decoder 23 with the previously stored note code. When there is found a coincidence between them, it produces an output signal toward the line determined by the block code previously stored. In this case, the pitch firstly stored in the first memory 431 is "G2". Accordingly, when the note code of the "G" appears on the lines 23*a* to 23*l*, the first memory 431 produces an output signal which in turn is applied to the AND gate 25*a*. Accordingly, the musical tone generating circuit 29 simultaneously forms two tones of "G2" and "D5" and sounds it with the loudspeaker 4.

When the key operation by the left hand is stopped, a reset signal is applied through the AND gate 4224 to the R-S flip-flop 4225, because at this time the AND gate 4409 produces a "1" signal and the reset output Q of the R-S flip-flop 4417 is "1". Accordingly, the set output Q of the R-S flip-flop becomes "0" and the switch control signal E for the AND gates 431*e* to 431*h* becomes "0", thus resulting in stoppage of the sounding of the musical tone "G2".

Subsequently, the right hand operates any one of the keys in the second key group 1*b* in accordance with the rhythm shown in FIGS. 6B and 6E and the left hand operates any key of the keys in the first key group 1*a* in accordance with the rhythm described in the rhythm note shown in FIGS. 6C and 6F. As a result, the musical tone generating circuit 29 forms musical tones with pitches as described in the musical note shown in FIGS. 6A and 6D.

In the above-mentioned embodiment, one octave is assigned for the first key group and the three octaves are assigned for the second key group. The keyboard may be divided with a proper ratio of the octaves and is not limited to that as mentioned above.

As described above, the electronic organ of the fourth embodiment of the invention previously stores both the melody and the accompaniment. In the read mode, any one of the keys of each key group obtained by functionally dividing the keyboard 1 with a given octave ratio is operated in accordance with the rhythm pattern of the accompaniment and the melody. Therefore, even a beginner can play difficult music in a simple manner, as described in the musical note.

It will be understood that the present invention is not limited to the first to fourth embodiments thus far described.

As mentioned above, in the present invention, a musical piece is previously stored in the memory through the key operation. In performing the music piece, the previously stored one is read out by operating the keys functionally divided on the keyboard. Alternatively, the stored music piece is transferred to the memory of the musical instrument per se by using a magnetic card, a magnetic tape, an RAM (random access memory), a package, or a bar code. It is read out for performance by using given keys on the keyboard.

The above-mentioned embodiments are so designed that the keyboard is functionally divided into two sections as to read out the previously stored accompaniment and/or melody for the performance thereof. This may be modified such that only the melody is stored in the memory and it may be read out and performed by using all the keys on the keyboard.

Further, the memory for storing the musical piece and reading out it through the key operations may be a semiconductor memory such as an RAM and any other suitable memory such as a digital magnetic tape as well.

What is claimed is:

1. An electronic musical instrument comprising:

a keyboard having a plurality of performance keys, each performance key being associated with a musical note;

memory means for serially storing pitch codes sequentially corresponding to a series of musical notes constituting a musical piece;

changeover switching means coupled to said keyboard for selectively switching an operation mode of said keyboard to a first normal performance mode, a second mode, or a third mode; in said first mode the performance keys on said keyboard designating the musical notes, in said second mode the performance keys on said keyboard permitting the pitch codes to be read out of said memory means sequentially, and in said third mode the performance keys on said keyboard inputting the pitch codes of said series of musical tones into said memory means;

musical tone generating means coupled to said keyboard, to said memory means and to said changeover switching means for generating musical tones in accordance with a key operation on said keyboard when said operation mode of said keyboard is switched to said first mode, and for generating musical tones corresponding to the pitch codes read out from said memory means when said operation mode of said keyboard is switched to the second mode, and for generating musical tones corresponding to the pitch codes to be inputted into said memory means by the key operation of said keyboard when said operating mode of said keyboard is switched to said third mode; and address incrementing means coupled to said memory means and to said changeover switching means, and being responsive to operation of any one of the performance keys on said keyboard when said operation mode of said keyboard is switched to the second mode for incrementing an address of the memory means by an operation of said any one of the keys on said keyboard such that pitch codes stored in said memory means are read out sequentially from said memory means according to an increment of the address of said memory means and said musical tones being formed by said musical tones generating means;

said address incrementing means incrementing an address of the memory means by the inputting operation of the performance keys on said keyboard when said operation mode of said keyboard is switched to third mode such that pitch codes corresponding to the key operation are stored in the address of said memory means which is designated by said address incrementing means.

2. An electronic musical instrument according to claim 1, further comprising tone period control means for causing the pitch code of said series of musical tones stored in said memory means to be read out from said memory means under the control of said address incrementing means, and for causing said musical tone to be produced by said musical tone generating means only during a period that any one of said keys on said keyboard is operated when said musical tone is formed by said musical tone generating means.

3. An electronic musical instrument according to claim 1, further comprising memory control means coupled to said memory means for previously storing the pitch codes of said series of musical tones in said memory means by means of key operations on said keyboard.

4. An electronic musical instrument according to claim 1, further comprising memory control means coupled to said memory means for previously storing pitch codes of said series of musical tones into said memory means by external input means.

5. An electronic musical instrument according to claim 2, further comprising memory control means coupled to said memory means for previously storing pitch codes of said series of musical tones into said memory means by external input means.

6. An electronic musical instrument according to claim 1, wherein said memory means is semiconductor memory means.

7. An electronic musical instrument according to claim 2, wherein said memory means is semiconductor memory means.

8. An electronic musical instrument according to claim 3, wherein said memory means is semiconductor memory means.

9. An electronic musical instrument comprising:

a single keyboard having a plurality of performance keys, each performance key being associated with a musical note;

first memory means for serially storing the pitch codes corresponding to the musical tones of the accompaniment of a musical piece;

second memory means for serially storing the pitch codes corresponding to the musical tones of the melody of a musical piece;

changeover switching means coupled to said keyboard for selectively switching an operation mode of said keyboard to a first normal performance mode, a second mode, a third mode, or a fourth mode; in said mode of the performance keys of said keyboard designating musical notes, in said second mode the performance keys on said keyboard being functionally and fixedly divided into two different key groups, and in said second mode the keys of either of said two different key groups on said keyboard permitting readout of the pitch codes stored in said first memory means and the keys of the other of said two different key groups permitting read out of the pitch codes stored in said second memory means, and in said third mode the performance keys on said keyboard inputting the pitch codes of said series of musical tones of the accompaniment of a musical piece into said first memory means, and in said fourth mode the performance keys on said keyboard inputting the pitch codes of said series of musical tones of the melody of a musical piece into said second memory means;

musical tone generating means coupled to said keyboard, to said first and second memory means and to said changeover switching means for generating musical tones in accordance with key operation on said keyboard when said operation mode of said keyboard is switched to the first mode and for generating musical tones corresponding to the pitch codes read out from said first and second memory means when said operation mode of said keyboard is switched to the second mode, and for generating musical tones corresponding to the pitch codes to be inputted into said first memory means by the key operation of said keyboard when said operation mode of said keyboard is switched to said third mode, and for generating musical tones corresponding to the pitch codes to be inputted into said first memory means by the key operation of said keyboard when said operation mode of said keyboard is switched to said fourth mode;

first control means coupled to said first memory means and to said changeover switching means, and being responsive to operation of any one of the keys of one of said two different keys groups when said operation mode of said keyboard is switched to the second mode for causing the pitch codes of said musical tones stored in said first memory means to be read out and for causing said tones to be formed by said musical generating means; and second control means coupled to said second memory means and to said changeover switching means, and being responsive to operation of any one of the keys of the other of said two different key groups when said operation mode of said keyboard is switched to the second mode for causing the pitch codes of said musical tones stored in said second memory means to be read out and for causing said musical tones to be formed by said tone generating means.

10. An electronic musical instrument according to claim 9, further comprising:

third control means coupled to said first control means for causing the pitch code of said musical tone stored in said first memory means to read out by said first control means, and when said musical tone is formed by said musical tone generating means, said musical tone of said tone generating means is outputted only during a period that any one of the keys of said one of said two key groups of said keyboard is operated; and fourth control means coupled to said second control means for causing the pitch code of said musical tone stored in said second memory means to be read out by said second control means, said musical tone generated by said musical tone generating means being produced only during a period that any one of the keys of said other of said two key groups of said keyboard is operated.

11. An electronic musical instrument according to claim 9, wherein each of said key groups of said single keyboard includes one or more keys.

12. An electronic musical instrument according to claim 10, wherein each of said key groups of said single keyboard includes one or more keys.

13. An electronic musical instrument according to claim 9, further comprising:

first memory control means for previously storing the pitch codes of a musical tone of the accompaniment of a musical piece through the operation of said keyboard; and second memory control means for previously storing the pitch code of a musical tone of the melody of the musical piece into said second memory means through the operation of said keyboard.

14. An electronic musical instrument according to claim 10, further comprising:

first memory control means for previously storing the pitch codes of a musical tone of the accompaniment of a musical piece through the operation of said keyboard; and second memory control means for previously storing the pitch code of musical tone of the melody of the musical piece into said second memory means through the operation of said keyboard.

15. An electronic musical instrument according to claim 9, further comprising:

first memory control means for previously storing the pitch codes of a musical tone of the accompaniment of a musical piece by external input means; and second memory control means for previously storing the pitch code of a musical tone of the melody of the musical piece into said second memory means by external input means.

16. An electronic musical instrument according to claim 10, further comprising:

first memory control means for previously storing the pitch codes of a musical tone of the accompaniment of a musical piece by external input means; and second memory control means for previously storing the pitch code of a musical tone of the melody of the musical piece into said second memory means by external input means.

17. An electronic musical instrument according to claim 9, wherein said first and second memory means are semiconductor memory means are semiconductor memory means.

18. An electronic musical instrument according to claim 10, wherein said first and second memory means are semiconductor memory means.

* * * * *